US011851898B2

(12) United States Patent
Asakura et al.

(10) Patent No.: US 11,851,898 B2
(45) Date of Patent: Dec. 26, 2023

(54) REBAR TYING TOOL

(71) Applicant: MAKITA CORPORATION, Anjo (JP)

(72) Inventors: Yuta Asakura, Anjo (JP); Shunta Mizuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 838 days.

(21) Appl. No.: 16/918,456

(22) Filed: Jul. 1, 2020

(65) Prior Publication Data

US 2021/0002911 A1 Jan. 7, 2021

(30) Foreign Application Priority Data

Jul. 5, 2019 (JP) ..... 2019-126058

(51) Int. Cl.

| | |
|---|---|
| ***E04G 21/12*** | (2006.01) |
| ***E04G 21/16*** | (2006.01) |
| ***E04C 5/16*** | (2006.01) |
| ***B21F 15/04*** | (2006.01) |

(52) U.S. Cl.

CPC ..... *E04G 21/16* (2013.01); *B21F 15/04* (2013.01); *E04C 5/163* (2013.01); *E04G 21/122* (2013.01)

(58) Field of Classification Search

CPC ... E04G 21/122; E04G 21/123; B65B 13/025; B65B 13/285; B21F 15/02; B21F 15/04

See application file for complete search history.

(56) References Cited

U.S. PATENT DOCUMENTS

| | | | | |
|---|---|---|---|---|
| 5,831,404 | A | 11/1998 | Ishii | |
| 2006/0254666 | A1 | 11/2006 | Kusakari et al. | |
| 2008/0110354 | A1* | 5/2008 | Itagaki | B65B 13/285 100/31 |
| 2011/0308404 | A1 | 12/2011 | Haberstroh et al. | |
| 2014/0084704 | A1 | 3/2014 | Yanagihara et al. | |
| 2017/0218631 | A1* | 8/2017 | Matsuno | B21F 15/04 |
| 2018/0155940 | A1 | 6/2018 | Nagaoka et al. | |
| 2018/0187433 | A1 | 7/2018 | Itagaki | |

(Continued)

FOREIGN PATENT DOCUMENTS

| | | | |
|---|---|---|---|
| CN | 103659751 | A | 3/2014 |
| CN | 107031891 | A | 8/2017 |
| CN | 107709682 | A | 2/2018 |

(Continued)

OTHER PUBLICATIONS

Aug. 23, 2022 Office Action issued in Chinese Patent Application No. 202010627052.7.

(Continued)

*Primary Examiner* — Debra M Sullivan
(74) *Attorney, Agent, or Firm* — Oliff PLC

(57) ABSTRACT

A rebar tying tool may include a twisting mechanism, a body, a grip, and a control board. The twisting mechanism may include a twisting motor and a holder configured to twist a wire around rebus by operation of the twisting motor. The body may house the twisting mechanism. The grip may be disposed below the body and configured to be gripped by an operator. The control board may be configured to control the operation of the twisting motor. The control board may be disposed below a connection between the grip and the body.

7 Claims, 17 Drawing Sheets

(56) References Cited

U.S. PATENT DOCUMENTS

| | | | |
|---|---|---|---|
| 2020/0149279 | A1 | 5/2020 | Matsuno |
| 2020/0399914 | A1 | 12/2020 | Nagaoka et al. |

FOREIGN PATENT DOCUMENTS

| | | | | | |
|---|---|---|---|---|---|
| JP | H05-031675 | A | | 2/1993 | |
| JP | H07-004048 | A | | 1/1995 | |
| JP | H10-046821 | A | | 2/1998 | |
| JP | 2005-061067 | A | | 3/2005 | |
| JP | 2010-184313 | A | | 8/2010 | |
| JP | 2016-223163 | A | | 12/2016 | |
| JP | 2017-160757 | A | | 9/2017 | |
| JP | 2018-091105 | A | | 6/2018 | |
| JP | 2018-108849 | A | | 7/2018 | |
| KR | 10-2010-0114755 | A | | 10/2010 | |
| WO | 2007/141822 | A1 | | 12/2007 | |
| WO | WO-2007141822 | A1 | * | 12/2007 | ..... E04G 21/122 |
| WO | 2017/073107 | A1 | | 5/2017 | |

OTHER PUBLICATIONS

Feb. 14, 2023 Office Action issued in Japanese Patent Application No. 2019-126058.

* cited by examiner

REBAR TYING TOOL

CROSS-REFERENCE TO RELATED APPLICATION

This application claims priority to Japanese Patent Application No. 2019-126058, filed on Jul. 5, 2019, the entire contents of which are hereby incorporated by reference into the present application.

TECHNICAL FIELD

The disclosure herein relates to a rebar tying tool.

BACKGROUND

Japanese Patent Application Publication No. 2018-108849 describes a rebar tying tool. The rebar tying tool includes a twisting mechanism, a body, and a control board. The twisting mechanism includes a twisting motor and a holder configured to twist a wire around rebars by operation of the twisting motor. The body houses the twisting mechanism and the control board. The control board is configured to control the operation of the twisting motor.

SUMMARY

In the above rebar tying tool, the control board is housed in the body together with the twisting mechanism. Due to this, heat generated by the operation of the twisting motor of the twisting mechanism is easily transferred to the control board. As a result, a temperature of the control board rises, which may lead to operational defects in controlling the twisting motor. The disclosure herein discloses an art for suppressing a temperature rise in a control board.

The disclosure herein discloses a rebar tying tool. The rebar tying tool may comprise a twisting mechanism, a body, a grip, and a control board. The twisting mechanism may comprise a twisting motor and a holder configured to twist a wire around rebars by operation of the twisting motor. The body may house the twisting mechanism. The grip may be disposed below the body and configured to be gripped by an operator. The control board may be configured to control the operation of the twisting motor. The control board may be disposed below a connection between the grip and the body.

In the above configuration, the control board is disposed below the connection between the grip and the body. Due to this, as compared to a case in which the control board is housed in the body, heat generated by the operation of the twisting motor is transferred significantly less to the control board. Due to this, a temperature rise in the control board can be suppressed, and an occurrence of an operational defect in controlling the twisting motor with the control board can be suppressed.

DETAILED DESCRIPTION

Figure 1:
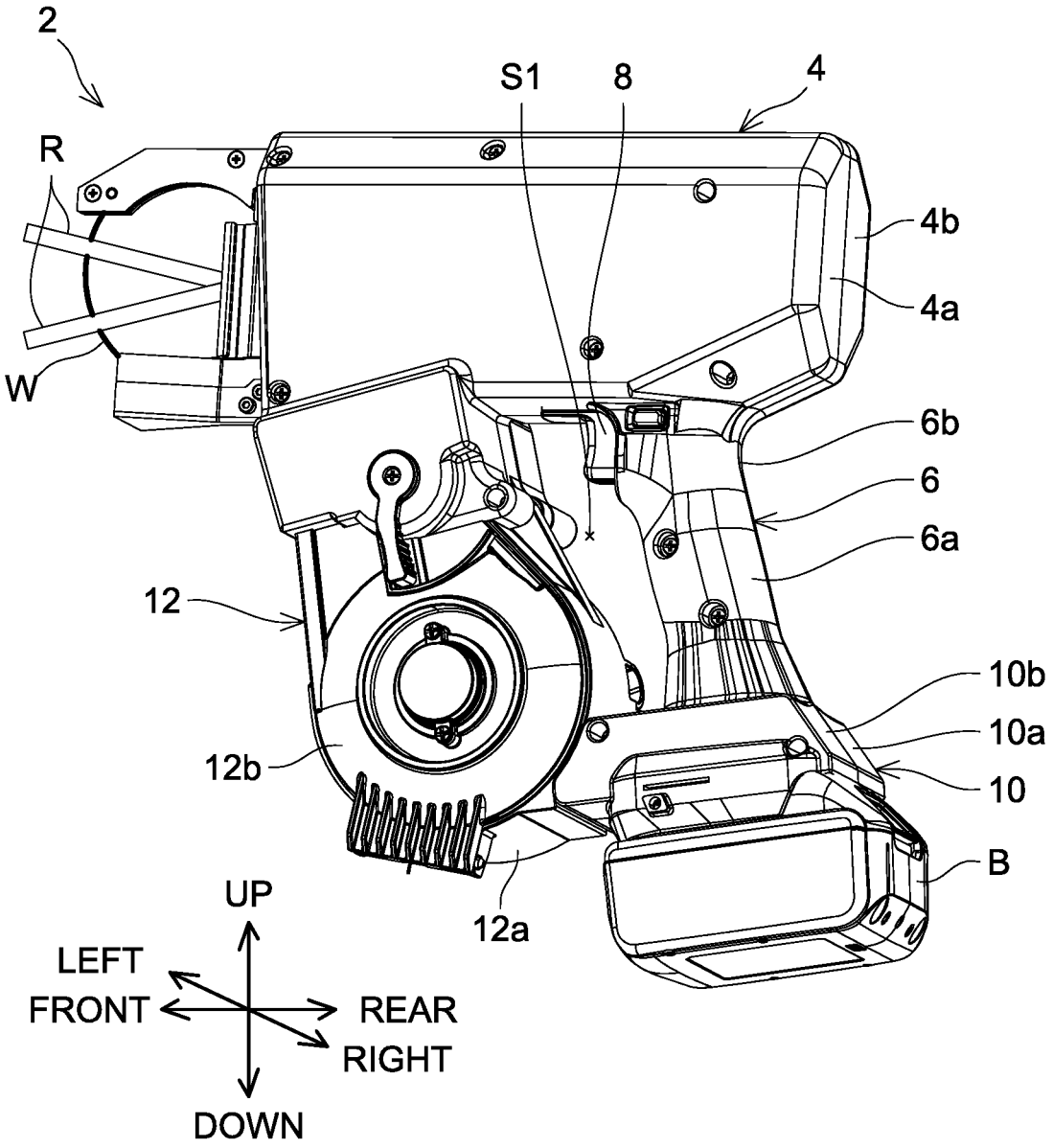
FIG. 1 is a perspective view of a power tool 2 of a first embodiment.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure.

Furthermore, each of the additional features and teachings disclosed below may be utilized separately or in conjunction with other features and teachings to provide improved rebar tying tools, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a rebar tying tool may comprise a twisting mechanism. The twisting mechanism may comprise a holder configured to hold a wire wound (wrapped) around rebars and a twisting motor configured to operate the holder. The twisting mechanism may be configured to perform a pulling operation of operating the twisting motor to pull the wire held by the holder in a direction separating away from the rebus and a twisting operation of operating the twisting motor to twist the wire held by the holder.

In the above configuration, the twisting mechanism is configured to perform the pulling operation and the twisting operation with the twisting motor, that is, with one motor. Due to this, as compared to a case in which the twisting mechanism performs the pulling operation and the twisting operation using multiple motors, control for operating the motor can be simplified.

In one or more embodiments, the twisting mechanism may further comprise a fixing unit configured to fix a tip end of the wire wound around the rebars or a portion of the wire wound around the rebars in a vicinity of a tip end (a tip end-neighboring portion). A rebar tying tool may further comprise a feed mechanism. The feed mechanism may comprise a feeder configured to feed out the wire and a feed motor configured to operate the feeder. The feed mechanism may be configured to perform a feeding-out operation of operating the feed motor to feed out the wire around the rebars, and a feeding-backward operation of operating the feed motor to feed backward the wire from around the rebars.

In the above configuration, even in a case where the wire fed out around the rebars by the feeding-out operation is loosened, the feed mechanism can perform the pulling-backward operation to reduce a loop diameter of the wire around the rebars and bring the wire into close contact with the rebars.

In one or more embodiments, the holder may comprise a screw shaft configured to rotate by operation of the twisting motor and a clamping member configured to open and close in conjunction with rotation of the screw shaft.

In the above configuration, the wire is held by the clamping member, which has been open, being closed. Due to this, the wire can be held with a simple configuration that uses opening and closing of the clamping member.

In one or more embodiments, the holder may further comprise a clamp guide configured to support the clamping member and a sleeve through which the clamp guide and the screw shaft are inserted. The sleeve is configured to progress and retract relative to the clamp guide in accordance with the rotation of the screw shaft, where the clamping member may be open when the sleeve is in a progressed position in which the sleeve is progressed relative to the clamp guide, and the clamping member may be closed when the sleeve is in a retracted position in which the sleeve is retracted relative to the clamp guide.

In the above configuration, the clamp guide and the screw shaft are inserted into the sleeve. Due to this, opening and closing operations of the clamping member can be realized with such a simple configuration using the rotation of the screw shaft.

In one or more embodiments, the sleeve may be coupled to the screw shaft via a ball screw. The sleeve may comprise a fin protruding from an outer surface of the sleeve. The rebar tying tool may further comprise a stopper configured to abut the fin in a rotation direction of the sleeve. The sleeve may progress and retract in accordance with the rotation of the screw shaft when the fin and the stopper abut each other, while the sleeve may rotate in accordance with the rotation of the screw shaft when the fin and the stopper do not abut each other.

In the above configuration, progressing and retracting operations and a rotating operation of the sleeve can be changed by a simple configuration that uses abutment of the fin and the stopper.

In one or more embodiments, the rebar tying tool may further comprise a cutting mechanism. The cutting mechanism may comprise a cutting member configured to cut the wire. The holder may comprise a push plate that operates the cutting member in conjunction with the operation of the twisting motor.

In the above configuration, the push plate is configured to operate the cutting member in conjunction with the operation of the twisting motor. Due to this, a separate motor for operating the cutting member does not need to be provided.

In one or more embodiments, a tying method may be a method of tying the wire around the rebars by the operation of the twisting motor. The tying method may comprise: feeding out the wire around the rebars; holding the wire wound around the rebars; pulling the held wire by an operation of the twisting motor in a direction separating away from the rebars; and twisting the held wire held by the operation of the twisting motor.

In the above configuration, the puling and the twisting are performed by the twisting motor, that is, with one motor. Due to this, as compared to a case in which the pulling and the twisting are performed using multiple motors, the control for operating the motor can be simplified.

In one or more embodiments, the tying method may further comprise: fixing a tip end of the wire wound around the rebars or a portion of the wire wound around the rebars in a vicinity of the tip end (tip end-neighboring portion); and pulling back the wire from around the rebars.

In the above configuration, even in the case where the wire fed out around the rebars by the feeding out is loosened, the loop diameter of the wire around the rebars can be reduced by performing the pulling back, by which the wire can be brought into close contact with the rebars.

In one or more embodiments, in the tying method, the pulling may be performed after the twisting has been performed, and the twisting may be performed again thereafter.

In a case where the wire is twisted in a state of being caught at a separated spot, which is separated from a desired tying spot of the rebars, when the wire may dislocate from the separated spot to the tying spot while the wire is being twisted, a gap is defined between the rebars and the wire and tying becomes defective. In the above configuration, after having been twisted in the twisting, the wire is pulled in the direction separating away from the rebars in the pulling, and is twisted again in the twisting that takes place thereafter. Due to this, even when a gap is defined between the rebars and the wire due to the wire being dislocated from the separated spot while the twisting for the first time is performed, the gap between the rebars and the wire is reduced by undergoing the pulling and the twisting for the second time, by which an occurrence of the tying becoming defective can be suppressed.

In one or more embodiments, a rebar tying tool may comprise a twisting mechanism, a body, a grip, and a control board. The twisting mechanism may comprise a twisting motor and a holder configured to twist a wire around rebars by operation of the twisting motor. The body may house the twisting mechanism. The grip may be disposed below the body and configured to be gripped by an operator. The control board may be configured to control the operation of the twisting motor. The control board may be disposed below a connection between the grip and the body.

In the above configuration, since the control board is disposed below the connection between the grip and the body, heat generated by the operation of the twisting motor is less likely to be transmitted to the control board as compared to a case in which the control board is housed in the body. Due to this, a temperature of the control board is suppressed from becoming high, and an occurrence of an operational defect in controlling the twisting motor by the control board can be suppressed.

In one or more embodiments, the rebar tying tool may further comprise a battery pack disposed below the grip and configured to supply electric power to the twisting motor. The control board may be disposed between the grip and the battery pack.

In the above configuration, the battery pack and the control board are electrically connected by wiring and the control board and the twisting motor are electrically connected by wiring. In the above configuration, since the battery pack, the control board, and the twisting motor are arranged in this order, lengths of the wiring can be shortened as compared to a case in which the battery pack, the control board, and the twisting motor are not arranged in this order.

In one or more embodiments, the rebar tying tool may further comprise a battery receptacle disposed below the grip and configured to receive the battery pack. The control board may be housed in the battery receptacle.

In the above configuration, a separate member for housing the control board does not need to be provided.

In one or more embodiments, the rebar tying tool may further comprise a reel around which the wire is to be wound. The reel may be disposed in front of the grip and below the body. The control board may be disposed traversing below the grip and below the reel.

In the above configuration, a space between the body and the control board can be efficiently used as compared to a configuration in which the control board is not disposed traversing below the grip and below the reel.

In one or more embodiments, the rebar tying tool may further comprise a reel around which the wire is to be wound. The reel may be disposed in front of the grip and below the body. The control board may be disposed between the grip and the reel.

In the above configuration, a space between the grip and the reel can be efficiently used as compared to a configuration in which the control board is not disposed between the grip and the reel.

In one or more embodiments, the rebar tying tool may further comprise a reel around which the wire is to be wound. The reel may be disposed in front of the grip and below the body. The control board may be disposed to overlap the reel in a left-right direction.

In the above configuration, the rebar tying tool can be suppressed from increasing its size in a front-rem direction as compared to a case in which the control board is not disposed to overlap the reel in the left-right direction.

In one or more embodiments, the rebar tying tool may tie the wire around the rebars. The rebar tying tool may comprise a clamping member including a first clamping member and a second clamping member facing the first clamping member in a first direction. The clamping member may be configured to clamp a first clamped portion and a second clamped portion that are located in respective ends-neighboring portions of the wire around the rebars between the first clamping member and the second clamping member.

In the above configuration, the wire around the rebars is clamped by the two members, being the first clamping member and the second clamping member. Due to this, as compared to a case of clamping the wire around the rebars by three members, a portion of the clamping member for clamping the wire can be made compact.

In one or more embodiments, the first clamping member may comprise a first portion and a second portion. The second clamping member may comprise a third portion and a fourth portion. The clamping member may clamp the first clamped portion of the wire at a first clamping portion between the second portion and the third portion, and may clamp the second clamped portion of the wire at a second clamping portion between the first portion and the fourth portion.

In the above configuration, the first clamped portion of the wire is clamped at the first clamping portion of the clamping member, and the second clamped portion of the wire is clamped at the second clamping portion of the clamping member. In other words, the wire is clamped at two portions of the clamping member. As a result, the wire can be suppressed from slipping out of the clamping member as compared to a case of clamping both the first and second clamped portions of the wire being clamped at only one portion of the clamping member.

In one or more embodiments, the clamping member may clamp the second clamped portion of the wire at the second clamping portion after having clamped the first clamped portion of the wire at the first clamping portion.

In the above configuration, a period for performing another operation may be ensured after the first clamped portion of the wire is clamped by the clamping member and before the second clamped portion of the wire is clamped.

In one or more embodiments, the rebar tying tool may further comprise a pulling back unit configured to pull back the wire around the rebars. The first clamped portion of the wire may be a tip end-neighboring portion of the wire. The pulling back unit may pull back the wire from the rebars in a state where the clamping member is clamping the first clamped portion of the wire at the first clamping portion, but not clamping the second darned portion of the wire at the second clamping portion.

In the above configuration, the wire is rewound from the rebars by an operation of the pilling back unit in a state where the tip end-neighboring portion of the wire is clamped by the clamping member. Due to this, the wire can be brought into close contact around the rebars.

In one or more embodiments, the clamping member may further comprise a retainer unit configured to be disposed between the rebars and the wire when the wire is clamped by the clamping member. The retainer unit may be configured to suppress the first and second clamped portions of the wire from slipping out from between the first and second clamping members.

In the above configuration, the first and second clamped portions of the wire are suppressed by the retainer unit from slipping out of the clamping member. Due to this, a defect of tying the wire caused by at least one of the first and second clamped portions of the wire slipping out of the clamping member can be suppressed.

In one or more embodiments, when the first clamping member moves, the second clamping member may, move in conjunction therewith.

In the above configuration, a period required for the clamping member to clamp the wire can be shortened as compared to a case in which only one of the first clamping member and the second clamping member moves.

In one or more embodiments, when the first clamping member and the second clamping member are seen along the first direction, the first clamping member and the second clamping member may move in directions approaching closer to each other.

In the above configuration, a distance by which the first and second clamping members move can be shortened as compared to a case in which only one of the first and second clamping members moves toward the other of the first and second clamping members.

First Embodiment

A power tool 2 of a first embodiment will be described with reference to FIGS. 1 to 17. The power tool 2 is a rehar tying tool configured to tie a wire W around a plurality of rebars R. For example, the power tool 2 is configured to tie the wire W around thin rebars R with a diameter of 16 mm or less, and around thick rebars R with a diameter greater than 16 mm (such as having a diameter of 25 mm or 32 mm). A diameter of the wire W is a value ranging from 0.5 mm to 2.0 mm, for example.

As shown in FIG. 1, the power tool 2 comprises a body 4, a grip 6, a battery receptacle 10, a battery pack B, and a reel holder 12. The body 4 comprises a left-side body 4*a* and a right-side body 4*b*. The left-side body 4*a* constitutes a left half of an outer shape of the body 4. The right-side body 4*b* constitutes a right half of the outer shape of the body 4. In this embodiment, a longitudinal direction of a twisting mechanism 30 to be described later is termed a front-rear direction, a direction orthogonal to the front-rear direction is termed an up-down direction, and a direction orthogonal to the front-rear direction and the up-down direction is termed a left-right direction.

The grip 6 is configured to be gripped by an operator. The grip 6 is connected to a rear lower portion of the body 4. The grip 6 is constituted integrally with the body 4. The grip 6 comprises a left-side grip 6*a* and a right-side grip 6*b*. The left-side grip 6*a* constitutes a left half of an outer shape of the grip 6. The right-side grip 6*b* constitutes a right half of the outer shape of the grip 6.

A trigger 8 is provided at a front upper portion of the grip 6. When the trigger 8 is pushed rearward, an operation of tying the wire W around the rebars R is performed.

The battery receptacle 10 is disposed below the grip 6. The battery receptacle 10 is integrally constituted with the grip 6. The battery receptacle 10 comprises a left-side battery receptacle 10*a* and a right-side battery receptacle 10*b*. The left-side battery receptacle 10*a* constitutes a left half of an outer shape of the battery receptacle 10. The right-side battery receptacle 10*b* constitutes a right half of the outer shape of the battery receptacle 10.

The battery pack B is configured to be detachably attached to the battery receptacle 10. The battery pack B is disposed below the grip 6 and the battery receptacle 10. The battery pack B is an electric power source for the power tool 2 to operate. The battery pack 13 includes a lithium ion battery cells, for example.

The reel holder 12 is disposed below the body 4. The reel holder 12 is disposed in front of the grip 6. The reel holder 12 is separated away forward from the grip 6, and a space S1 for the operator to grip the grip 6 is provided between the reel holder 12 and the grip 6.

Figure 2:
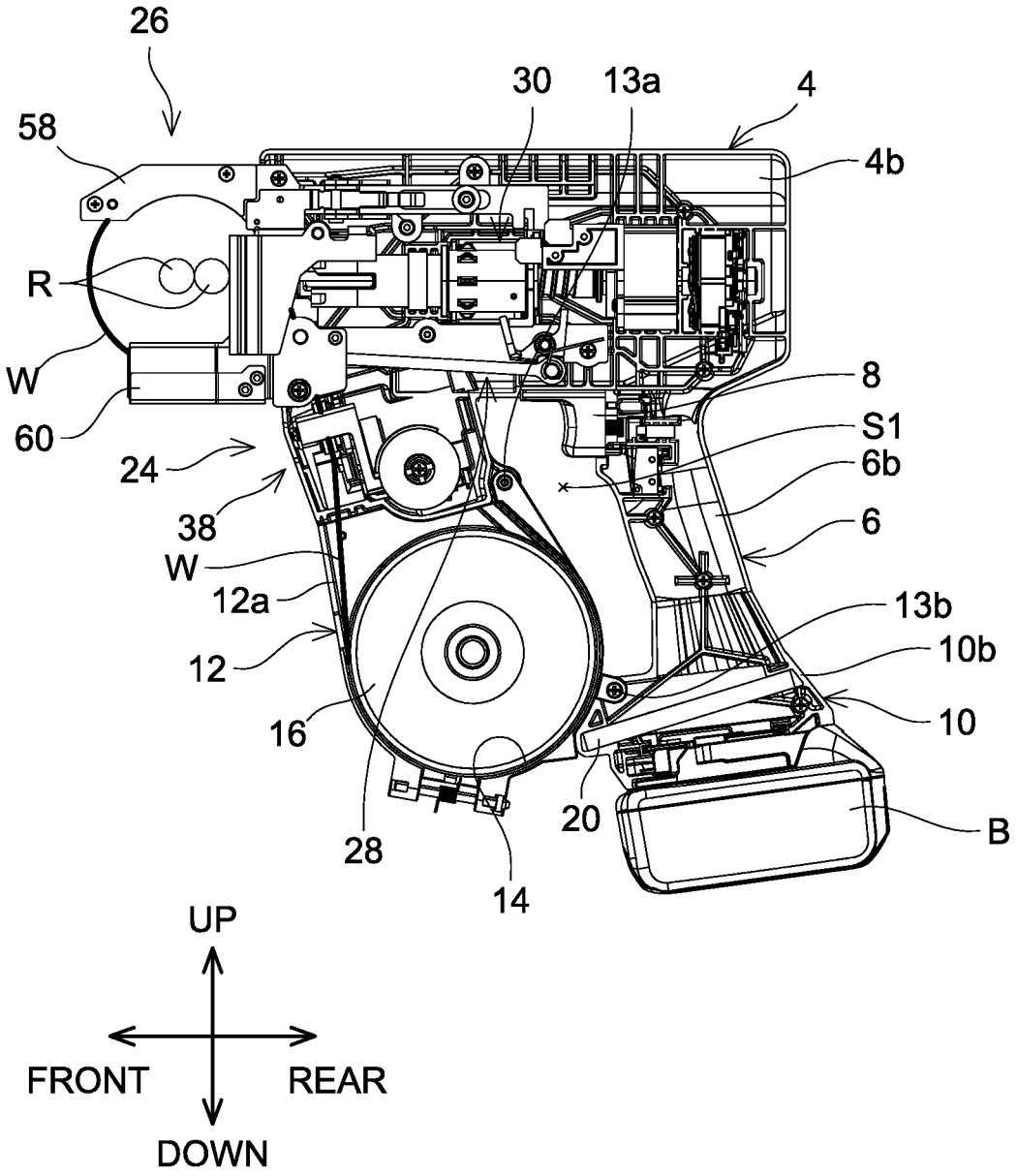
FIG. 2 is a side view of the power tool 2 of the first embodiment in a state of having detached a left-side body 4*a*, a left-side grip 6*a*, a left-side battery receptacle 10*a*, and a cover member 12*b*.

The reel holder 12 comprises a holder housing 12*a* and a cover member 12*b*. The holder housing 12*a* is mounted to a front lower portion of the body 4 by a screw 13*a*, and is mounted to a front portion of the battery receptacle 10 by a screw 13*b*. The cover member 12*b* is mounted rotatably to the holder housing 12*a*. The cover member 12*b* is configured to open and close an opening of the holder housing 12*a*. As shown in FIG. 2, a housing space 14 is defined by the holder housing 12*a* and the cover member 12*b*. A reel 16 around which the wire W is wound is configured to be disposed in the housing space 14. That is, the reel holder 12 is configured to house the reel 16 therein.

The power tool 2 further comprises a control board 20. The control board 20 is configured to perform control for performing an operation to tie the wire W around the rebars R when the trigger 8 is pushed rearward. The control board 20 is disposed below a connection between the body 4 and the grip 6. The connection is positioned at the rear lower portion of the body 4. The control board 20 is separated downward from the body 4. The control board 20 is disposed between the grip 6 and the battery pack B. The control board 20 is housed in the battery receptacle 10.

Figure 3:
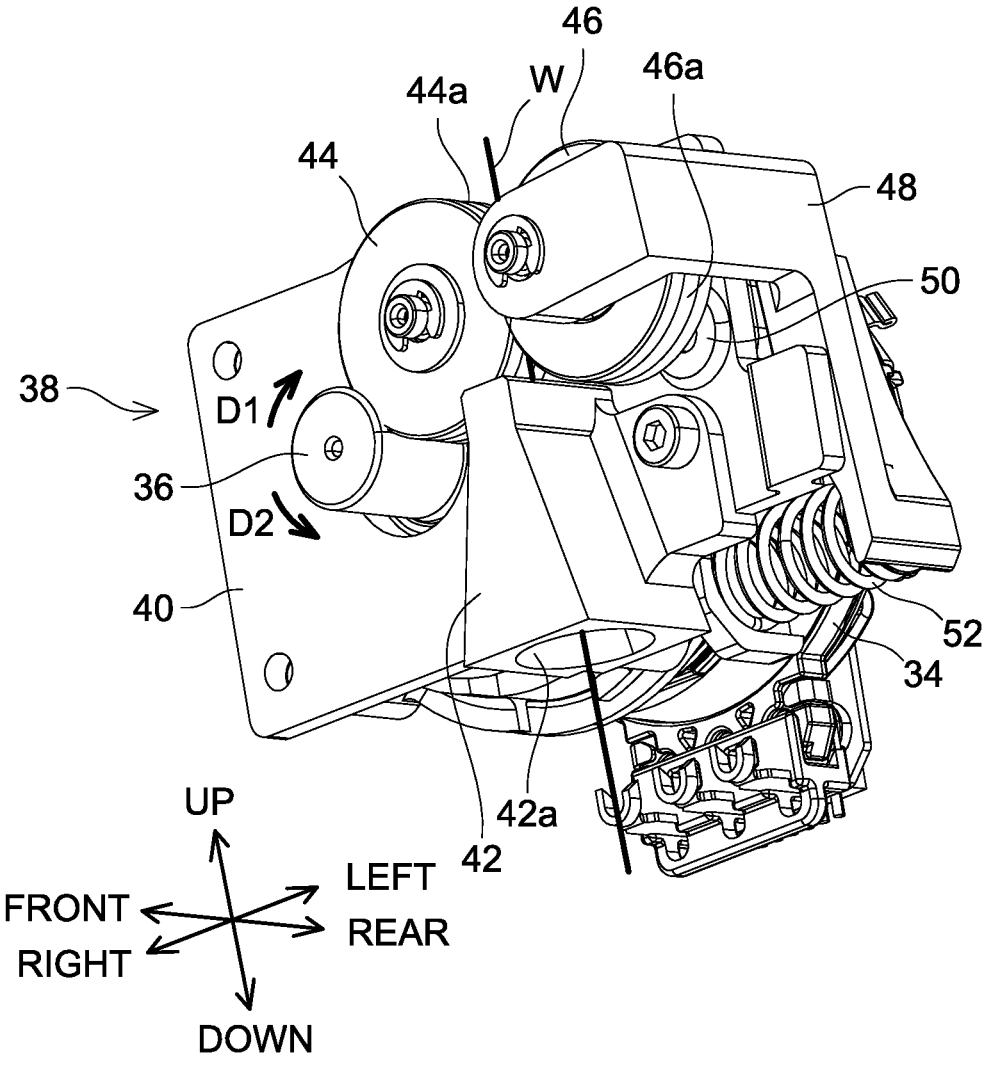
FIG. 3 is a perspective view of a feeder 38 of the power tool 2 of the first embodiment.

The power tool 2 comprises a feed mechanism 24, a cutting mechanism 28, and a twisting mechanism 30. The feed mechanism 24 is disposed at a front lower portion of the body 4. The feed mechanism 24 is mounted to the right-side body 4*b*. The feed mechanism 24 comprises a feed motor 34 and a feeder 38 shown in FIG. 3 and a reduction gear unit 35 and a guide 26 shown in FIG. 4. The feed motor 34 shown in FIG. 3 is connected to the control board 20 by wiring that is not shown. The feed motor 34 operates by electric power supplied from the battery pack B. An operation of the feed motor 34 is controlled by the control board 20. A shaft of the feed motor 34 rotates in both a forward direction D1 and a reverse direction D2. Hereinbelow, the shaft of the feed motor 34 rotating in the forward direction D1 is expressed as the feed motor 34 operating in a forward mode, and the shaft of the feed motor 34 rotating in the reverse direction D2 is expressed as the feed motor 34 operating in a reverse mode.

The reduction gear unit 35 is coupled to the shaft of the feed motor 34. The reduction gear unit 35 is configured to reduce rotation of the feed motor 34 by a plurality of reduction gears.

The feeder 38 is configured to execute a feeding-out operation of feeding out the wire W to the guide 26 and a feeding-backward operation of feeding backward the wire W from the guide 26. As shown in FIG. 2, the feeder 38 is disposed at a front lower portion of the body 4. The feeder 38 is housed in the body 4. The feeder 38 is disposed above the reel 16.

As shown in FIG. 3, the feeder 38 comprises a base member 40, a guide member 42, a driving gear 44, a driven gear 46, a gear support member 48, and a biasing member 52. The guide member 42 is fixed to the base member 40. The guide member 42 is configured to guide the wire W upward. The guide member 42 has a guide hole 42*a*. The guide hole 42*a* has a tapered shape with a broad lower end and a narrow upper end. The wire W passes through the guide hole 42*a*.

The driving gear 44 and the driven gear 46 are disposed above the guide member 42. The driving gear 44 is rotatably supported on the base member 40. The driving gear 44 meshes with an output gear 36 of the reduction gear unit 35. The driving gear 44 is configured to rotate by rotation of the output gear 36. The driving gear 44 has a groove 44*a*. The groove 44*a* is formed on a part of left-right direction width of an outer circumferential surface of the driving gear 44 in a direction along a rotation direction of the driving gear 44.

The driven gear 46 meshes with the driving gear 44. The driven gear 46 is rotatably supported by the gear support member 48. The driven gear 46 has a groove 46*a*. The groove 46*a* is formed on a part of left-right direction width of an outer circumferential surface of the driven gear 46 in a direction along a rotation direction of the driven gear 46.

The gear support member 48 is pivotably supported on the base member 40 via a pivot shaft 50. The biasing member 52 is interposed between the gear support member 48 and the base member 40. The biasing member 52 biases the gear support member 48. Due to this, the gear support member 48 pivots about the pivot shaft 50. Torque acting in a direction bringing the driven gear 46 closer to the driving gear 44 is applied to the gear support member 48. Due to this, the driven gear 46 is pressed against the driving gear 44. As a result, the wire W is clamped between the groove 44*a* of the driving gear 44 and the groove 46*a* of the driven gear 46. When the gear support member 48 is pushed in a direction contracting the biasing member 52, the driven gear 46 separates from the driving gear 44. Due to this, in a case of replacing the reel 16, the wire W can easily be passed between the groove 44*a* of the driving gear 44 and the groove 46*a* of the driven gear 46.

The wire W moves when the feed motor 34 rotates in a state of having the wire W clamped between the groove 44*a* of the driving gear 44 and the groove 46*a* of the driven gear 46. When the feed motor 34 operates in the forward mode, the wire W is fed out toward the guide 26. On the other hand, when the feed motor 34 operates in the reverse mode, the wire W is fed backward from the guide 26.

Figure 4:
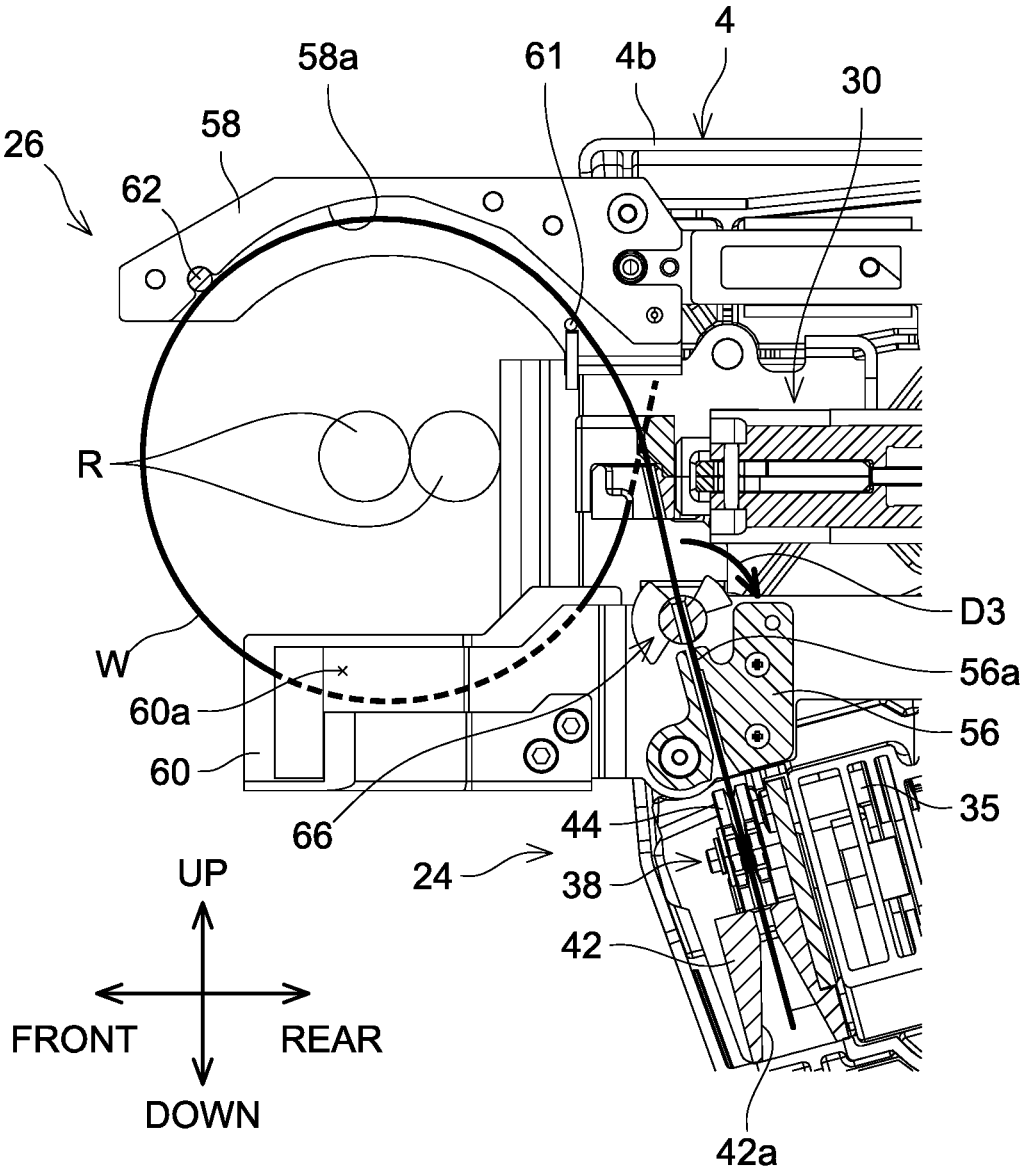
FIG. 4 is a cross-sectional view of a vicinity of a guide 26 of the power tool 2 of the first embodiment.

The guide 26 shown in FIG. 4 is configured to guide the wire W fed out from the feeder 38 around the rebars R in a loop shape. The guide 26 comprises an upper-side guide 58, a lower-side guide 60, a wire guide 56, a first guide pin 61, and a second guide pin 62. The wire W having been fed out from the feeder 38 passes through inside the wire guide 56. A protrusion 56*a* is formed inside the wire guide 56.

The upper-side guide 58 and the lower-side guide 60 are disposed at the front portion of the body 4. The upper-side guide 58 has an upper-side guide passage 58*a*. The wire W which has passed through inside the wire guide 56 passes through the upper-side guide passage 58*a*. The first guide pin 61 and the second guide pin 62 are disposed in the upper-side guide passage 58*a*. When the wire W passes through the upper-side guide passage 58*a* while being in contact with the protrusion 56*a* of the wire guide 56, the first guide pin 61, and the second guide pin 62, the wire W is given a downward curl shape.

The lower-side guide 60 has a lower-side guide passage 60*a*. The wire W which has passed through the upper-side guide passage 58*a* passes through the lower-side guide passage 60*a*. In FIG. 4, a part of the wire W that is not visible by being hidden behind the lower-side guide 60 and the twisting mechanism 30 is shown by a broken line.

Figure 5:
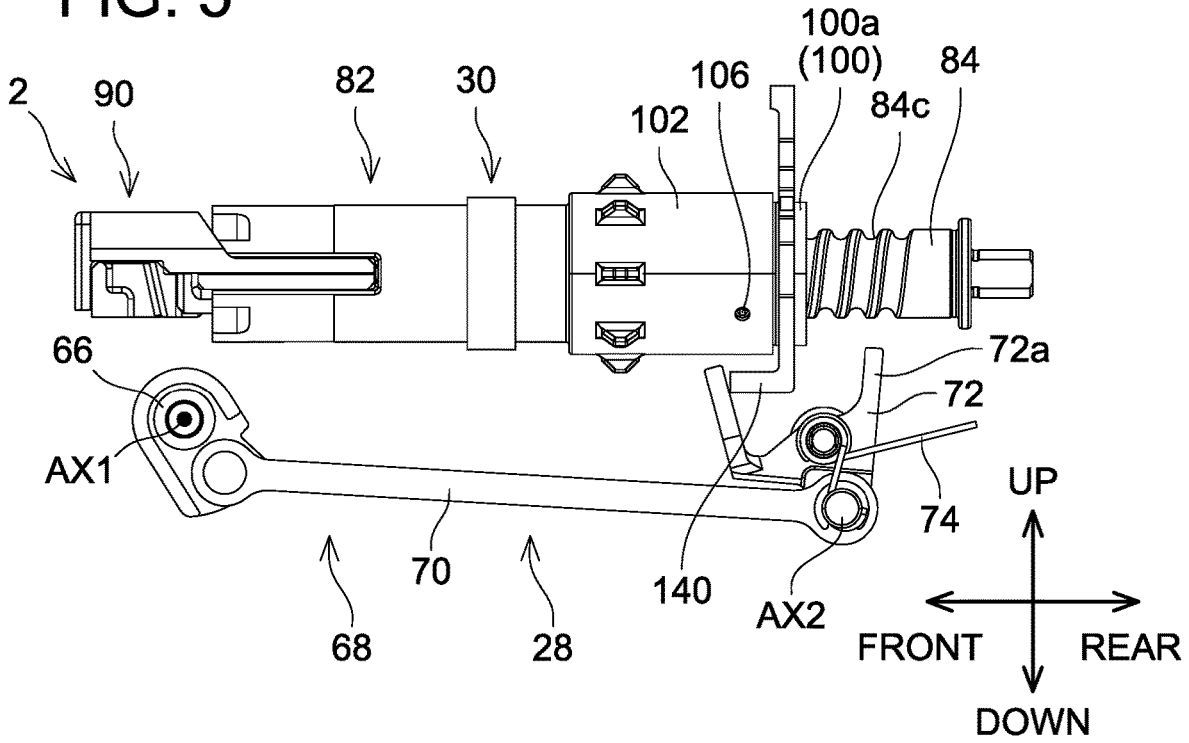
FIG. 5 is a side view of a holder 82 and a cutting mechanism 28 of the power tool 2 of the first embodiment in a state where an operated member 72 is in an initial position.

As shown in FIG. 5, the power tool 2 further comprises the cutting mechanism 28. The cutting mechanism 28 is configured to cut the wire W in a state of being wound around the rebars R. The cutting mechanism 28 is housed in the body 4 (see FIG. 2). The cutting mechanism 28 comprises a cutting member 66 and a link 68. The cutting member 66 is configured to cut the wire W. The cutting member 66 is disposed on a passage through which the wire W having been fed out from the feeder 38 passes before reaching the upper-side guide passage 58*a*. The wire W passes through inside the cutting member 66. When the cutting member 66 pivots in a direction D3 shown in FIG. 4, the wire W is cut inside the cutting member 66.

The link 68 comprises a coupling member 70, an operated member 72, and a biasing member 74. The coupling member 70 couples the cutting member 66 and the operated member 72. In a normal state, the operated member 72 is biased to an initial position by the biasing member 74. When a force greater than a biasing force by the biasing member 74 is applied to the operated member 72, the operated member 72 pivots about a pivot axis AX2. Due to this, the cutting member 66 pivots about a pivot axis AX1 via the coupling member 70. When the operated member 72 pivots about the pivot axis AX2 to a predetermined position shown in FIG. 6 from the initial position, the wire W is cut by pivot of the cutting member 66. Hereinbelow, a position of the operated member 72 in the aforementioned state is called a cutting position.

Figure 7:
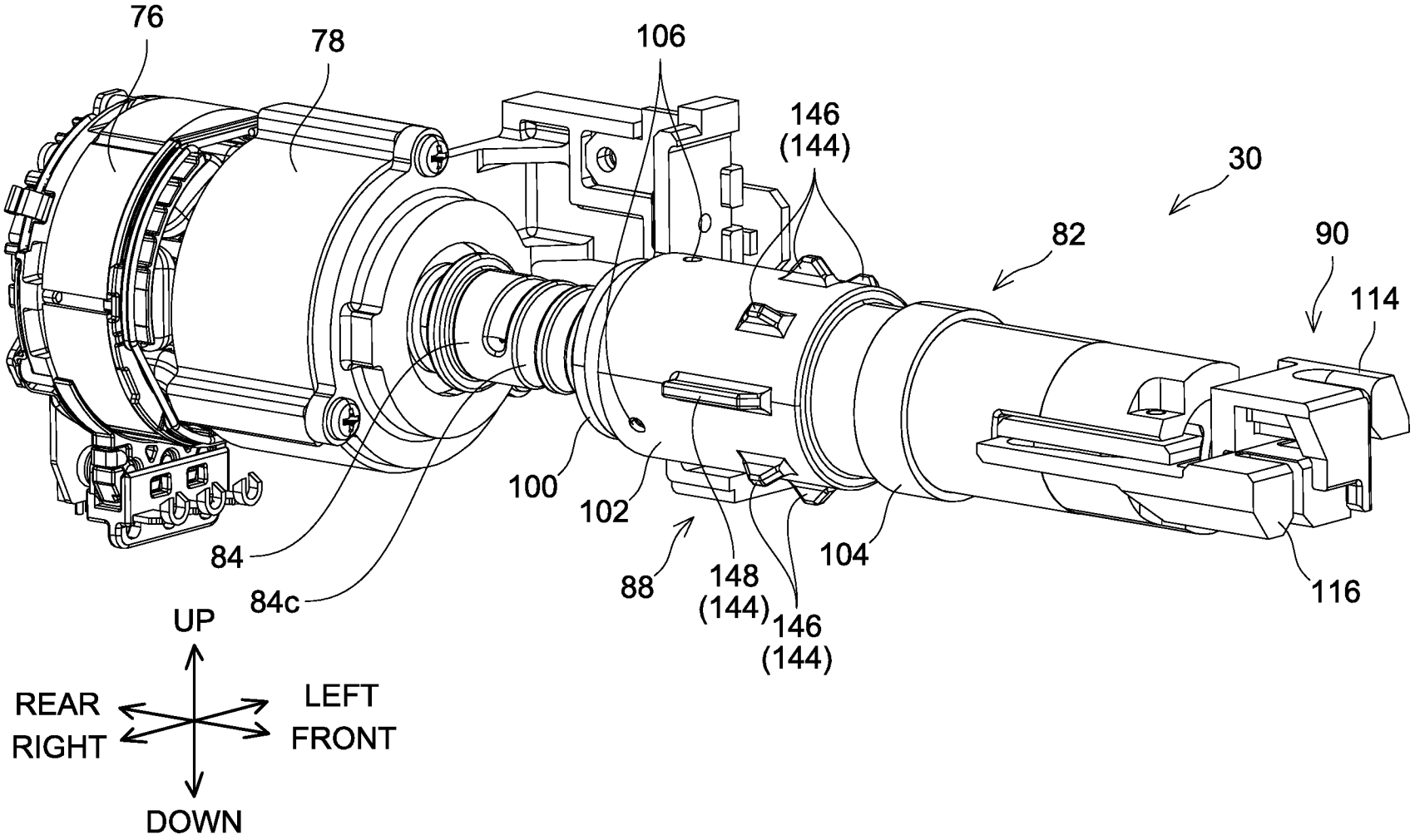
FIG. 7 is a perspective view of a twisting mechanism 30 of the power tool 2 of the first embodiment.

The twisting mechanism 30 shown in FIG. 7 is configured to twist the wire W around the rebars R. As shown in FIG. 2, the twisting mechanism 30 extends in the front-rear direction. The twisting mechanism 30 is disposed above the feeder 38 and the cutting mechanism 28. The twisting mechanism 30 is housed in the body 4. In the up-down direction, the twisting mechanism 30 is disposed to overlap with the reel 16 and the control board 20.

As shown in FIG. 7, the twisting mechanism 30 comprises a twisting motor 76, a reduction gear unit 78, and a holder 82. The twisting motor 76 is electrically connected to the control board 20 by wiring that is not shown. The twisting motor 76 operates by the electric power supplied from the battery pack B. An operation of the twisting motor 76 is controlled by the control board 20.

The reduction gear unit 78 is coupled to a front portion of a shaft of the twisting motor 76. The reduction gear unit 78 reduces rotation of the shaft of the twisting motor 76 by a plurality of reduction gears and transmits the same to the holder 82.

Figure 8:
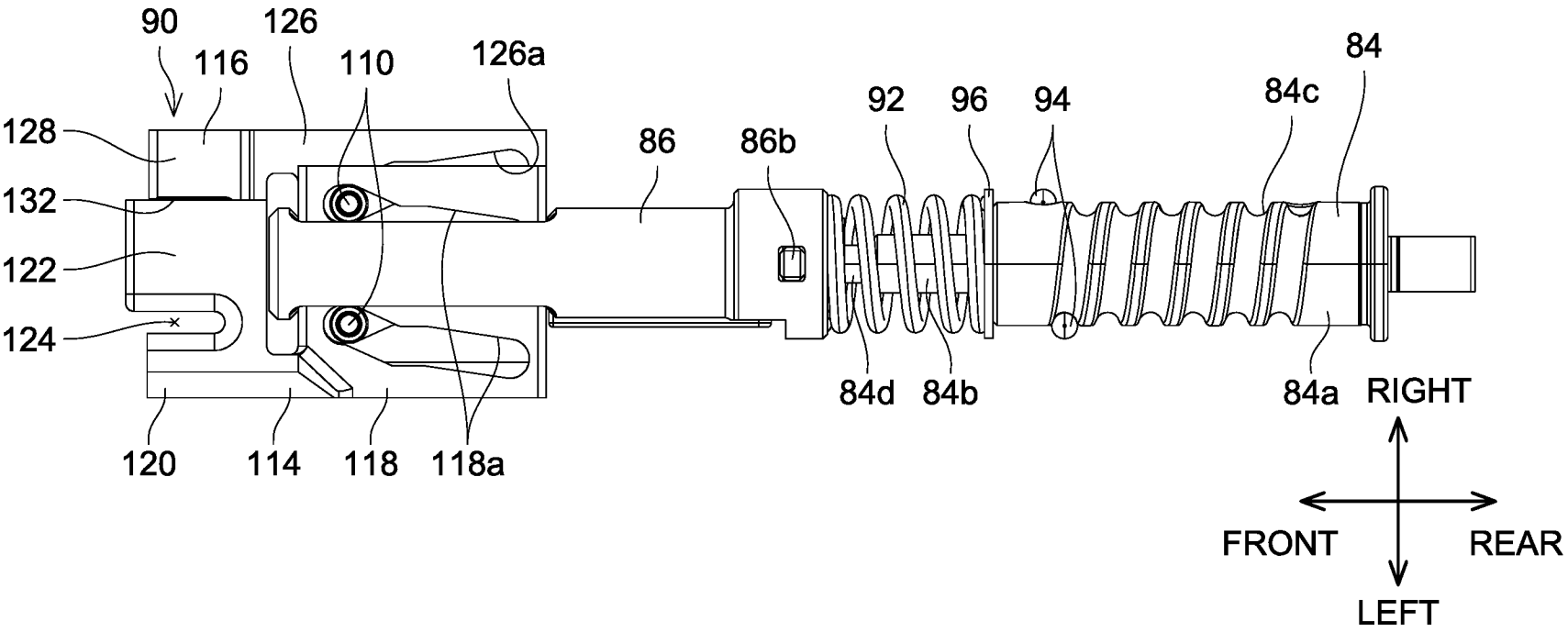
FIG. 8 is a top view of a screw shaft 84, a clamp guide 86, a clamping member 90, and a biasing member 92 of the power tool 2 of the first embodiment.
Figure 9:
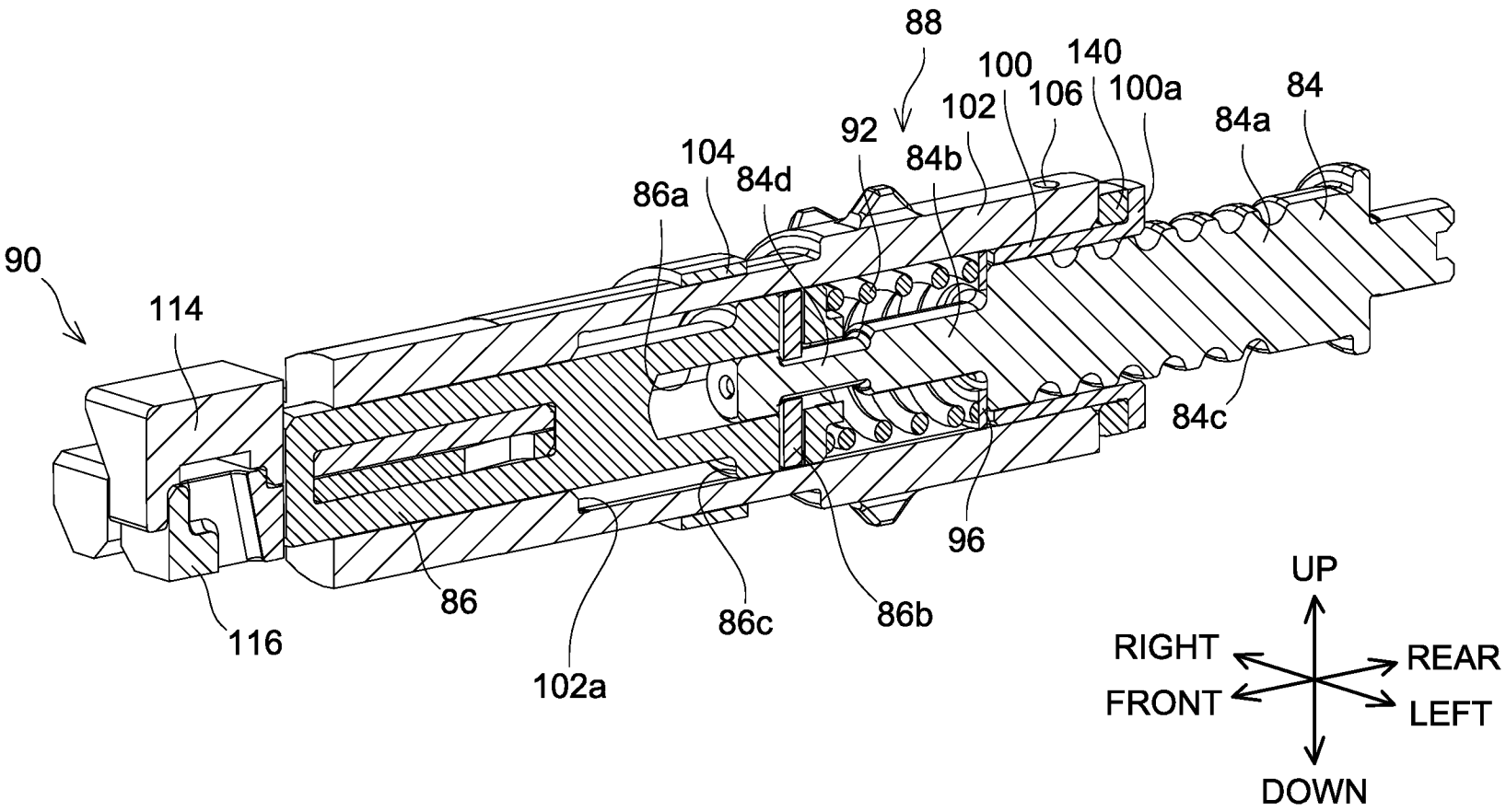
FIG. 9 is a cross-sectional perspective view of the holder 82 in a state where an outer sleeve 102 of the power tool 2 of the first embodiment is in a progressed position relative to the clamp guide 86.

As shown in FIGS. 7 to 9, the holder 82 comprises a screw shaft 84, a clamp guide 86, a biasing member 92, a sleeve 88, and a clamping member 90.

As shown in FIG. 7, the screw shaft 84 is coupled to the reduction gear unit 78. The screw shaft 84 rotates in both a left-hand screw direction and a right-hand screw direction when the screw shaft 84 is seen from a rear side by the operation of the twisting motor 76. Hereinbelow, when the screw shaft 84 is seen from the rear side, the screw shaft 84 rotating in the left-hand screw direction by the operation of the twisting motor 76 is expressed as the twisting motor 76 operating in the forward mode, and the screw shaft 84 rotating in the right-hand screw direction by the operation of the twisting motor 76 is expressed as the twisting motor 76 operating in the reverse mode.

As shown in FIG. 8, the screw shaft 84 comprises a large diameter portion 84*a* and a narrow diameter portion 84*b*. The large diameter portion 84*a* is positioned at a rear portion of the screw shaft 84 and the narrow diameter portion 84*b* is positioned at a front portion of the screw shaft 84. A spiral-shaped ball groove 84*c* is formed on an outer circumferential surface of the large diameter portion 84*a*. A ball 94 engages with the ball groove 84*c*. A ling-shaped washer 96 is arranged at a step between the large diameter portion 84*a* and the narrow diameter portion 84*b*. An engaging groove 84*d* is formed at a front portion of the narrow diameter portion 84*b*.

As shown in FIG. 9, the front portion of the narrow diameter portion 84*b* is inserted into a rear opening 86*a* of the clamp guide 86. An engaging pin 86*b* of the clamp guide 86 engages with an engaging groove 84*d* of the narrow diameter portion 84*b* of the screw shaft 84. The screw shaft 84 and the clamp guide 86 are thereby engaged. A step portion 86*c* is formed on an outer circumferential surface of the clamp guide 86. The outer circumferential surface of the clamp guide 86 positioned on the rear side of the step portion 86*c* has a larger diameter than the outer circumferential surface of the clamp guide 86 on the front side of the step portion 86*c*.

Further, the narrow diameter portion 84*b* is inserted through the biasing member 92. The biasing member 92 is disposed between the washer 96 and the clamp guide 86. The biasing member 92 biases the clamp guide 86 in a direction separating away from the washer 96.

The screw shaft 84 and the clamp guide 86 are inserted into the sleeve 88. The sleeve 88 comprises an inner sleeve 100 and an outer sleeve 102. The large diameter portion 84*a* of the screw shaft 84 is inserted into the inner sleeve 100. A ball hole (not shown) is formed on the inner sleeve 100. The ball 94 engages with the ball hole. The inner sleeve 100 is coupled with the screw shaft 84 via the ball 94 engaged between the ball groove 84*c* and the ball hole. In a range where the ball groove 84*c* is formed, the screw shaft 84 rotates relative to the inner sleeve 100 when the screw shaft 84 rotates by the operation of the twisting motor 76. Due to this, the inner sleeve 100 moves in the front-rear direction relative to the screw shaft 84.

The screw shaft 84, the clamp guide 86, and the inner sleeve 100 are inserted into the outer sleeve 102. The outer sleeve 102 has a hollow cylindrical shape extending in the front-rear direction. A step portion 102*a* is formed on an inner circumferential surface of the outer sleeve 102. The inner circumferential surface of the outer sleeve 102 on the front side of the step portion 102*a* has a smaller diameter than the inner circumferential surface of the outer sleeve 102 on the rear side of the step portion 102*a*. The outer sleeve 102 is fixed to the inner sleeve 100 by a stopper screw 106. The outer sleeve 102 is configured to operate with the inner sleeve 100 (that is, moves in the front-rear direction or rotates in the left-hand screw direction and in the right-hand screw direction). In the range where the ball groove 84*c* is formed, the screw shaft 84 rotates relative to the inner sleeve 100 when the screw shaft 84 rotates by the operation of the twisting motor 76. Due to this, the outer sleeve 102 moves together with the inner sleeve 100 in the front-rear direction relative to the screw shaft 84. Further, when the screw shaft 84 rotates relative to the inner sleeve 100, the outer sleeve 102 moves between the progressed position and the retracted position relative to the clamp guide 86. Hereinbelow, the outer sleeve 102 moving toward the progressed position relative to the clamp guide 86 (that is, forward) is expressed as the outer sleeve 102 progressing, and the outer sleeve 102 moving toward the retracted position relative to the clamp guide 86 (that is, rearward) is expressed as the outer sleeve 102 retracting.

The holder 82 further comprises a support member 104. The support member is configured to support the outer sleeve 102. The support member 104 covers a part of an outer circumferential surface of the outer sleeve 102. The support member 104 is configured to be rotatable relative to the outer sleeve 102. The support member 104 is configured to be movable in the front-rear direction relative to the outer sleeve 102. The support member 104 is supported by the body 4. The support member 104 cannot move in the front-rear direction relative to the body 4.

The clamping member 90 is supported by a front portion of the clamp guide 86. The clamping member 90 is supported by two guide pins 110 mounted on the outer sleeve 102 (see FIG. 8) rotatably relative to the outer sleeve 102. The clamping member 90 is configured to clamp the wire W. The clamping member 90 is configured to open and close in conjunction with the rotation of the screw shaft 84.

Figure 10:
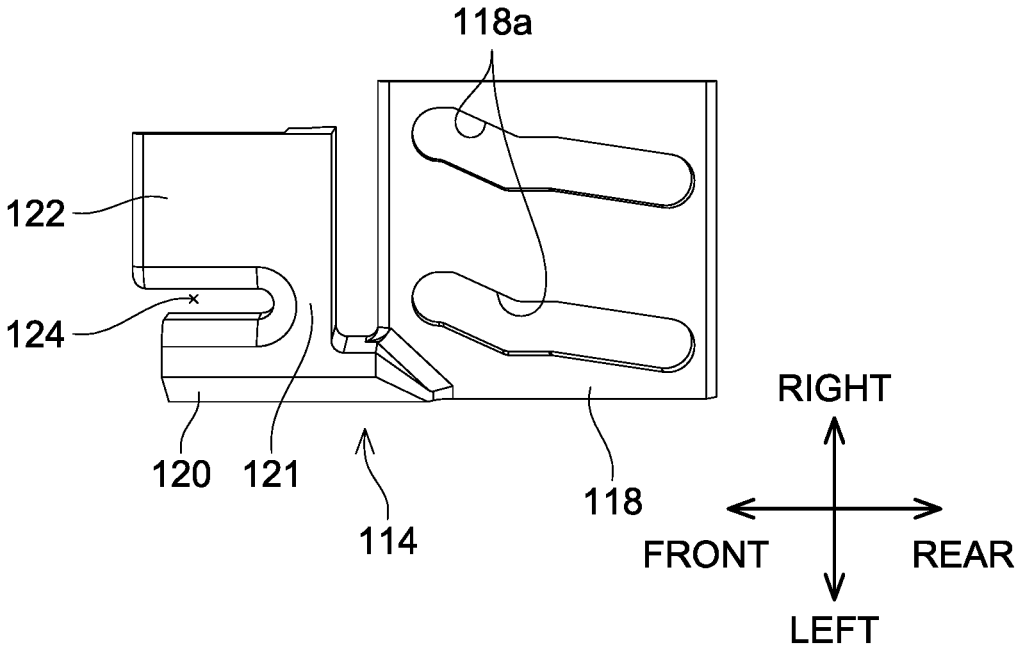
FIG. 10 is a top view of an upper-side clamping member 114 of the power tool 2 of the first embodiment.

The clamping member 90 comprises an upper-side clamping member 114 and a lower-side clamping member 116. As shown in FIG. 7, the upper-side clamping member 114 is disposed to face the lower-side clamping member 116 in the up-down direction. As shown in FIG. 10, the upper-side clamping member 114 comprises an upper-side base portion 118, a first upper-side protrusion 120, an upper-side coupling portion 121, and a second upper-side protrusion 122. The upper-side base portion 118 is configured to be supported by the clamp guide 86 and the guide pins 110. The upper-side base portion 118 comprises two upper-side guide holes 118*a*. The two upper-side guide holes 118*a* have a same shape as one another. The two upper-side guide holes 118*a* extend in the front-rear direction, and are inclined rightward from the rear side to the front side when the upper-side base portion 118 is seen from above.

The first upper-side protrusion 120 extends forward from a left front end of the upper-side base portion 118. The upper-side coupling portion 121 extends rightward from a central right end of the first upper-side protrusion 120. The second upper-side protrusion 122 extends forward from the upper-side coupling portion 121. The first upper-side protrusion 120 and the second upper-side protrusion 122 are separated in the left-right direction. A first wire passage 124 is disposed between the first upper-side protrusion 120 and the second upper-side protrusion 122. The wire W having been fed out from the feeder 38 of the feed mechanism 24 and before reaching the upper-side guide passage 58*a* of the guide 26 passes through the first wire passage 124.

Figure 12:
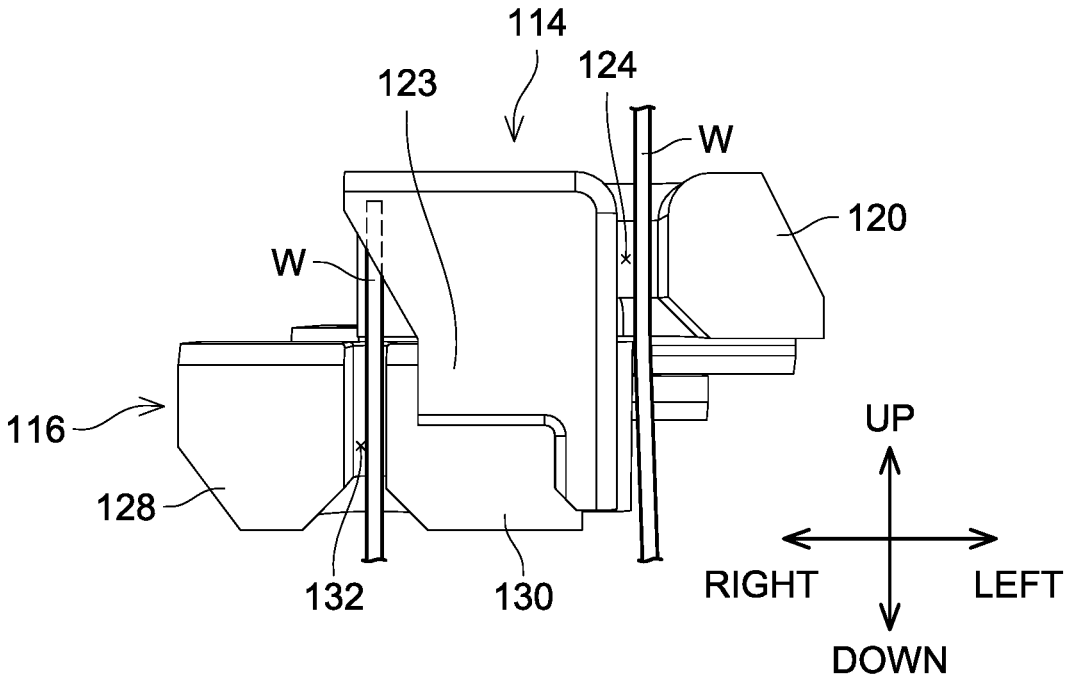
FIG. 12 is a front view of the clamping member 90 of the power tool 2 of the first embodiment.

The clamping member 90 further comprises a first retainer unit 123 shown in FIG. 12. The first retainer unit 123 is integrally constituted with the upper-side clamping member 114. The first retainer unit 123 extends downward from a front end of the second upper-side protrusion 122. The first retainer unit 123 is disposed to partially overlap the lower-side clamping member 116 in the front-rear direction. The first retainer unit 123 is configured to suppress the wire W clamped by the clamping member 90 from slipping out from the clamping member 90.

Figure 11:
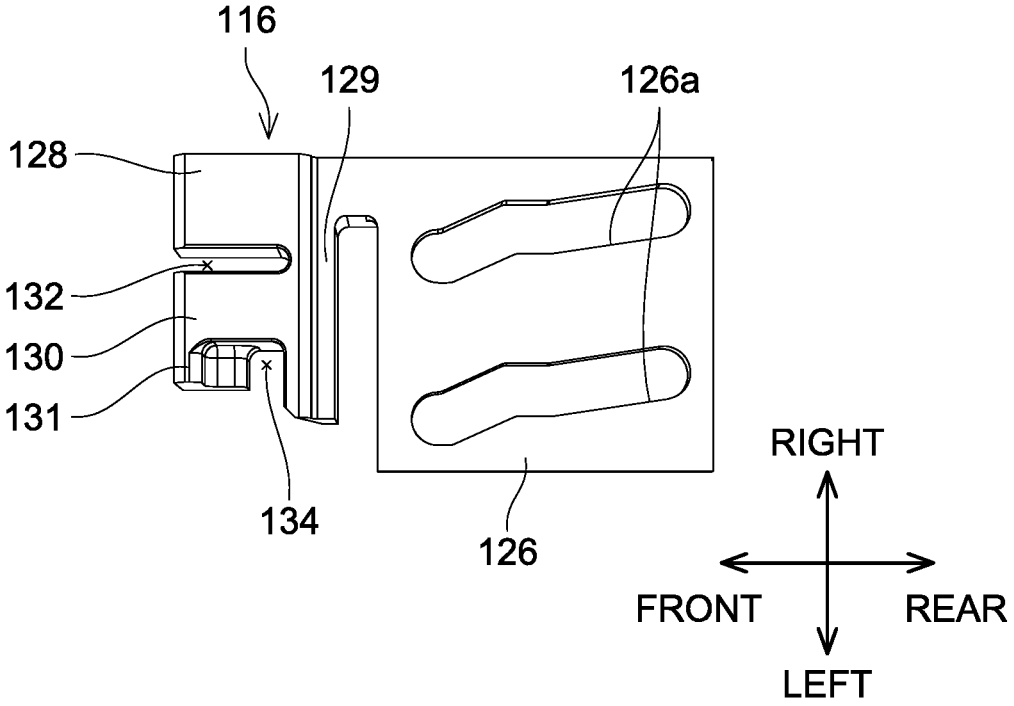
FIG. 11 is a top view of a lower-side clamping member 116 of the power tool 2 of the first embodiment.

As shown in FIG. 11, the lower-side clamping member 116 comprises a lower-side base portion 126, a first lower-side protrusion 128, a lower-side coupling portion 129, and a second lower-side protrusion 130. The lower-side base portion 126 is configured to be supported by the clamp guide 86 and the guide pins 110. The lower-side base portion 126 comprises two lower-side guide holes 126*a*. A shape of the lower-side guide holes 126*a* when the lower-side base portion 126 is seen from above is in a plane symmetric relationship with a shape of the upper-side guide holes 118*a* when the upper-side base portion 118 is seen from above with respect to a plane that intersects perpendicularly to the left-right direction. That is, the two lower-side guide holes 126*a* extend in the front-rear direction, and are inclined leftward from the rear side toward the front side when the lower-side base portion 126 is seen from above.

The first lower-side protrusion 128 extends forward from a right front end of the lower-side base portion 126. The lower-side coupling portion 129 extends leftward from a central left end of the first lower-side protrusion 128. The second lower-side protrusion 130 extends forward from a central front end of the lower-side coupling portion 129. The first lower-side protrusion 128 and the second lower-side protrusion 130 are separated from each other in the left-right direction. A second wire passage 132 is disposed between the first lower-side protrusion 128 and the second lower-side protrusion 130. The wire W having passed through the lower-side guide passage 60*a* of the guide 26 passes through the second wire passage 132.

The clamping member 90 further comprises a second retainer unit 131. The second retainer unit 131 is constituted integrally with the lower-side clamping member 116. The second retainer unit 131 extends leftward from a left front end of the second lower-side protrusion 130. The second retainer unit 131 is configured to suppress the wire W clamped by the clamping member 90 from slipping out of the clamping member 90. The second retainer unit 131 and the lower-side coupling portion 129 are separated from each other in the front-rear direction. An auxiliary passage 134 is disposed between the second retainer unit 131 and the lower-side coupling portion 129.

As shown in FIG. 8, the guide pins 110 of the outer sleeve 102 pass through the respective upper-side guide holes 118*a* and lower-side guide holes 126*a* in a state where the upper-side clamping member 114 is disposed to partially overlap the lower-side clamping member 116 in the up-down direction. When the outer sleeve 102 moves in the front-rear direction relative to the clamp guide 86, the guide pins 110 move in the front-rear direction within the upper-side guide holes 118*a* and the lower-side guide holes 126*a*. In a case where the guide pins 110 are arranged in front portions of the upper-side guide holes 118*a* and the lower-side guide holes 126*a*, the first wire passage 124 and the second wire passage 132 are open as shown in FIG. 12. A state of the clamping member 90 at this occasion is termed a fully-open state.

Figure 13:
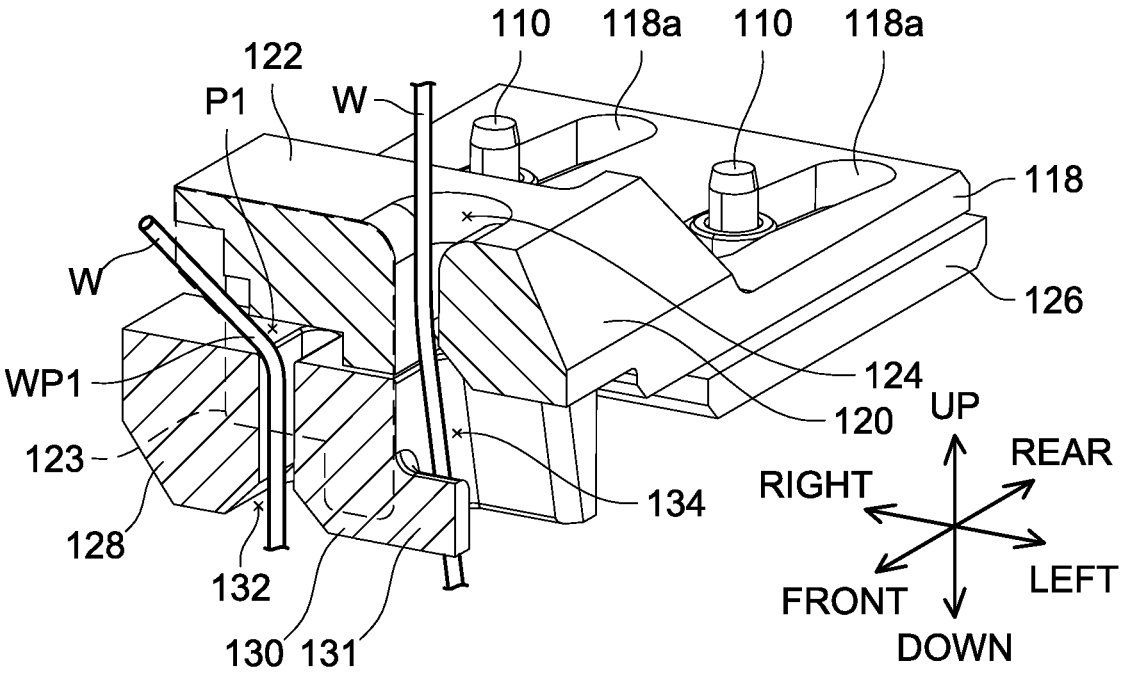
FIG. 13 is a cross-sectional perspective view of the clamping member 90 and guide pins 110 of the power tool 2 of the first embodiment in a state where the guide pins 110 are in intermediate positions between upper-side guide holes 118*a* and lower-side guide holes 126*a*.

When the outer sleeve 102 retracts relative to the clamp guide 86, the guide pins 110 move rearward within the upper-side guide holes 118*a* and the lower-side guide holes 126*a*. When the upper-side clamping member 114 moves rightward relative to the clamp guide 86, the lower-side clamping member 116 moves leftward relative to the clamp guide 86 (that is, in an opposite direction from the direction in which the upper-side clamping member 114 moves) in conjunction therewith. A distance by which the upper-side clamping member 114 moves rightward is equal to a distance by which the lower-side clamping member 116 moves leftward. When the clamping member 90 is seen along the up-down direction, the upper-side clamping member 114 and the lower-side clamping member 116 move in directions approaching each other. As shown in FIG. 13, when the guide pins 110 move to intermediate positions within the upper-side guide holes 118*a* and the lower-side guide holes 126*a*, the second wire passage 132 is closed by the second upper-side protrusion 122. On the other hand, the first wire passage 124 is open by the auxiliary passage 134 disposed in the second lower-side protrusion 130. A state of the clamping member 90 at this occasion is termed a half-open state. In a case where the wire W is arranged in the second wire passage 132, the wire W is fixed by being clamped at a first clamping portion P1 between the second upper-side protrusion 122 and the first lower-side protrusion 128. Hereinbelow, a portion of the wire W clamped by the first clamping portion P1 will be termed a first clamped portion WP1. In the half-open state, the first retainer unit 123 closes the first clamping portion P1 from the front side. In FIG. 13, a position of the first retainer unit 123 in the front-rear direction is indicated by a broken line. The first retainer unit 123 is disposed between the rebars R (not shown in FIG. 13) and the first clamping portion P1.

Figure 14:
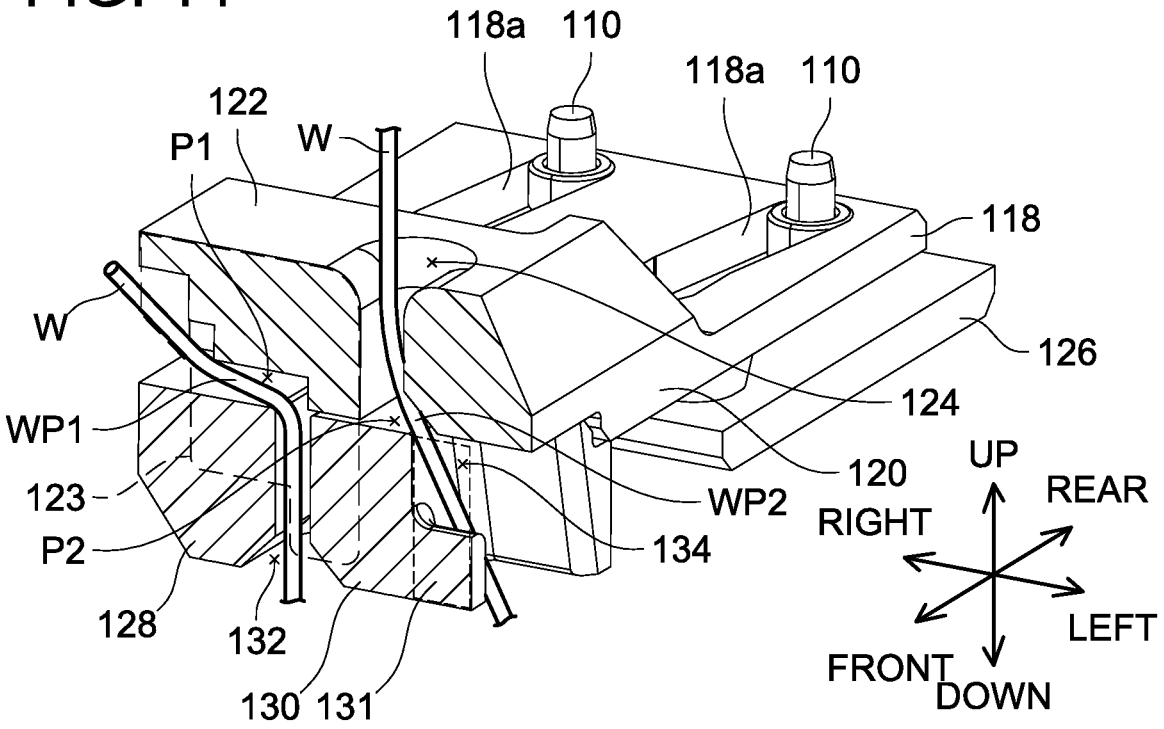
FIG. 14 is a cross-sectional perspective view of the clamping member 90 and the guide pins 110 of the power tool 2 of the first embodiment in a state where the guide pins 110 are at rear portions of the upper-side guide holes 118*a* and the lower-side guide holes 126*a*.

As shown in FIG. 14, when the guide pins 110 move to rear portions of the upper-side guide holes 118*a* and the lower-side guide holes 126*a*, the first wire passage 124 is closed by the second lower-side protrusion 130. The second wire passage 132 remains closed by the second upper-side protrusion 122. A state of the clamping member 90 at this occasion will be termed a fully-closed state. In a case where the wire W is arranged in the first wire passage 124, the wire W is fixed by being clamped at a second clamping portion P2 between the first upper-side protrusion 120 and the second lower-side protrusion 130 while the first clamped portion WP1 of the wire W remains clamped at the first clamping portion P1 of the clamping member 90. Hereinbelow, a portion of the wire W clamped by the second clamping portion P2 will be termed a second clamped portion WP2. In the fully-closed state, the first retainer unit 123 closes the first clamping portion P1 from the front side and the second retainer unit 131 is arranged on the front side immediately below the second clamping portion P2. In FIG. 14, a front end of the second retainer unit 131 is indicated by a broken line with a shorter pitch than the broken line indicating the first retainer unit 123. The second retainer unit 131 is disposed between the rebars R (not shown in FIG. 14) and the second clamping portion P2.

As shown in FIG. 5, the holder 82 further comprises a push plate 140. The push plate 140 is held between a rear end of the outer sleeve 102 and a rib 100*a* positioned at a rear end of the inner sleeve 100. The push plate 140 moves in the front-rear direction relative to the screw shaft 84 together with the inner sleeve 100 and the outer sleeve 102 by the rotation of the screw shaft 84 accompanying the operation of the twisting motor 76.

Figure 6:
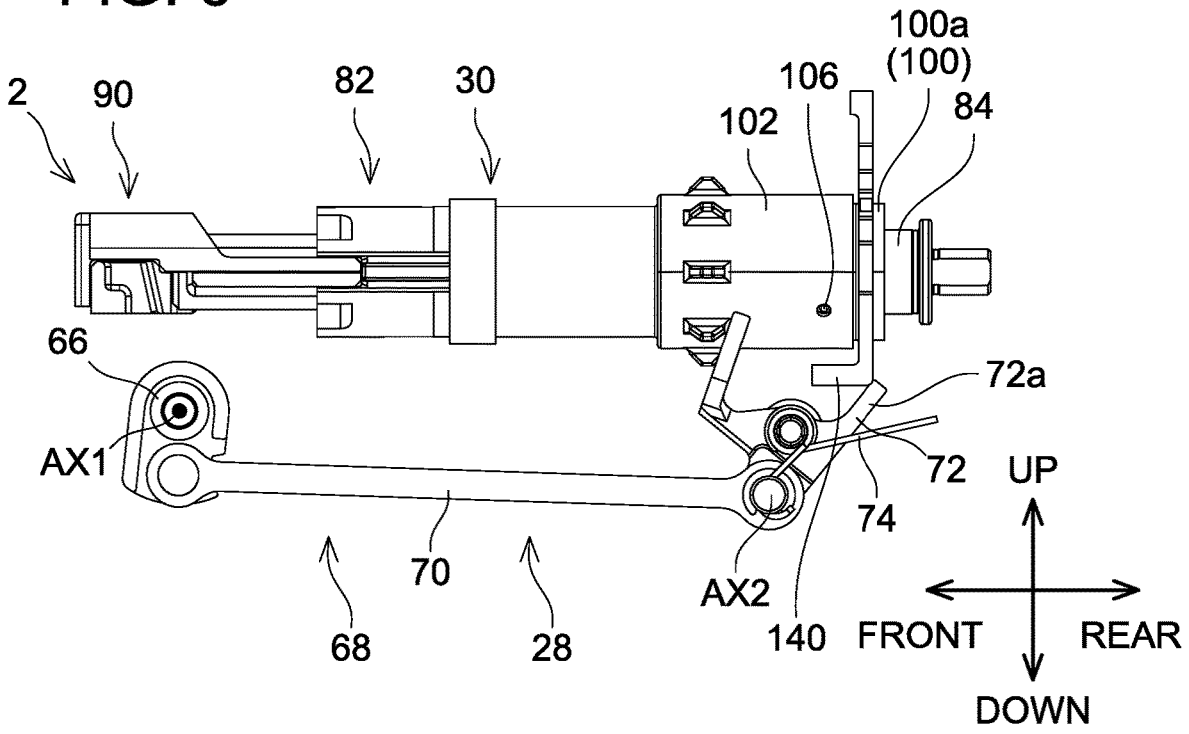
FIG. 6 is a side view of the holder 82 and the cutting mechanism 28 of the power tool 2 of the first embodiment in a state where the operated member 72 is in a cutting position.

The push plate 140 is configured to operate the operated member 72 of the cutting mechanism 28. In the normal state, the push plate 140 is separated from a protrusion 72*a* of the operated member 72. In this state, the operated member 72 is in the initial position. When the push plate 140 retracts relative to the screw shaft 84 by the rotation of the screw shaft 84, the push plate 140 abuts the protrusion 72*a* and pushes the operated member 72 rearward. Due to this, the operated member 72 pivots about the pivot axis AX2, and the cutting member 66 pivots about the pivot axis AX1 via the coupling member 70. The push plate 140 can operate the cutting member 66 by operating the operated member 72. As shown in FIG. 6, when the operated member 72 pivots to the cutting position, the wire W passing through inside the cutting member 66 is cut by the cutting member 66. After this, when the push plate 140 progresses relative to the screw shaft 84 by the rotation of the screw shaft 84, the operated member 72 is biased by the biasing member 74 and pivots about the pivot axis AX2 to the initial position.

As shown in FIG. 7, fins 144 are formed on the outer circumferential surface of a rear portion of the outer sleeve 102. Each of the fins 144 extends in the front-rear direction. The fins 144 are radially disposed. The fins 144 are configured to allow or prohibit rotation of the outer sleeve 102. In this embodiment, eight fins are disposed on the outer circumferential surface of the outer sleeve 102 with a 45-degrees interval between each other. Further, in this embodiment, the fins 144 comprises seven short fins 146 and one long fin 148. A length of the long fin 148 in the front-rear direction is longer than a length of the short fins 146 in the front-rear direction. In the front-rear direction, a position of a front end of the long fin 148 is same as positions of front ends of the short fins 146. On the other hand, in the front-rear direction, a rear end of the long fin 148 is positioned on the rear side from rear ends of the short fins 146.

Figure 15:
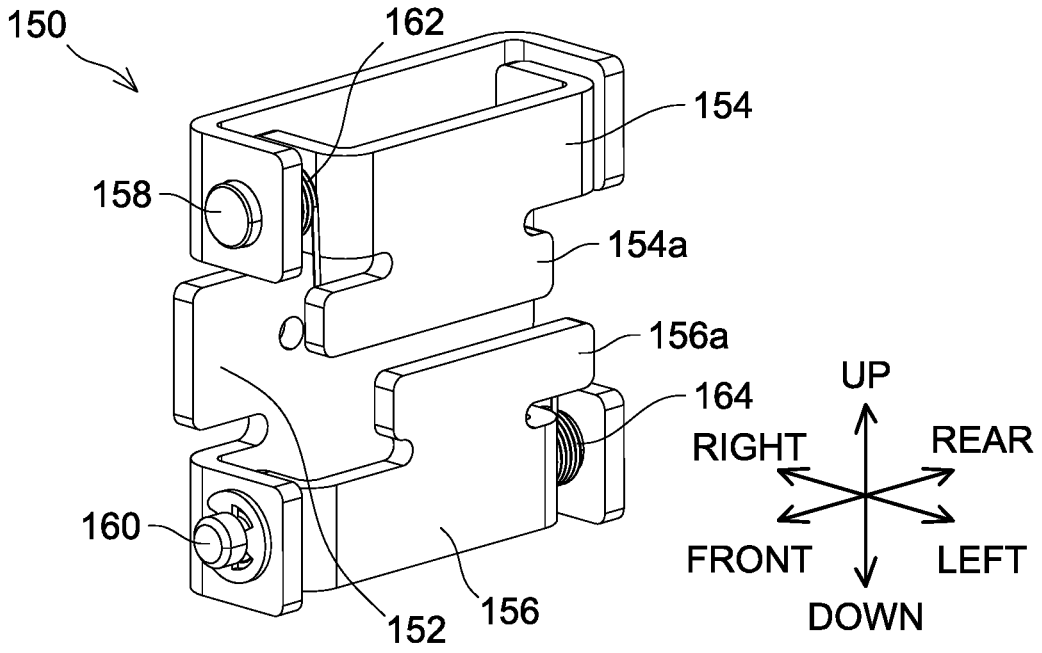
FIG. 15 is a perspective view of a rotation restricting member 150 of the power tool 2 of the first embodiment.

The power tool 2 further comprises a rotation restricting member 150 shown in FIG. 15. The rotation restricting member 150 is disposed at a position in a vicinity of the outer sleeve 102 (see FIG. 17), and is configured to allow or prohibit the rotation of the outer sleeve 102 by cooperating with the fins 144. As shown in FIG. 15, the rotation restricting member 150 comprises a base member 152, an upper-side stopper 154, a lower-side stopper 156, sliding shafts 158, 160, and biasing members 162, 164. The base member 152 is fixed to the right-side body 4*b*. The upper-side stopper 154 is slidably supported on the base member 152 via the sliding shaft 158. The upper-side stopper 154 comprises a restriction piece 154*a*. The restriction piece 154*a* is positioned at a lower portion of the upper-side stopper 154. The biasing member 162 biases the restriction piece 154*a* in a direction opening outward (that is, direction along which the restriction piece 154*a* separates away from the base member 152).

In a case where the screw shaft 84 rotates in the right-hand screw direction when the screw shaft 84 is seen from the rear side, the short fins 146 and the long fin 148 push in the restriction piece 154*a* inward. Due to this, the upper-side stopper 154 does not prohibit the rotation of the outer sleeve 102. On the other hand, in a case where the screw shaft 84 rotates in the left-hand screw direction when the screw shaft 84 is seen from the rear side, the short fins 146 and the long fin 148 abut the restriction piece 154*a* in a rotation direction of the outer sleeve 102. Due to this, the upper-side stopper 154 prohibits the rotation of the outer sleeve 102. The case where the screw shaft 84 rotates in the right-hand screw direction when the screw shaft 84 is seen from the rear side corresponds to a case where the twisting mechanism 30 has finished twisting the wire W around the rebars R and returns to its initial state. Further, the case where the screw shaft 84 rotates in the left-hand screw direction when the screw shaft 84 is seen from the rear side corresponds to a ease where the twisting mechanism 30 clamps and twists the wire W around the rebars R.

The lower-side stopper 156 is slidably supported on the base member 152 via the sliding shaft 160. The lower-side stopper 156 comprises a restriction piece 156*a*. The restriction piece 156*a* is disposed at an upper portion of the lower-side stopper 156. The restriction piece 156*a* faces the restriction piece 154*a*. A rear end of the restriction piece 156*a* is disposed on the rear side from a rear end of the restriction piece 154*a*. A front end of the restriction piece 156*a* is disposed on the rear side from a front end of the restriction piece 154*a*. The biasing member 164 biases the restriction piece 156*a* in a direction opening outward (that is, direction along which the restriction piece 156*a* separates away from the base member 152).

In the case where the screw shaft 84 rotates in the right-hand screw direction when the screw shaft 84 is seen from the rear side, the short fins 146 and the long fin 148 abut the restriction piece 156*a* in the rotation direction of the outer sleeve 102. Due to this, the lower-side stopper 156 prohibits the rotation of the outer sleeve 102. On the other hand, in the case where the screw shaft 84 rotates in the left-hand screw direction when the screw shaft 84 is seen from the rear side, the short fins 146 and the long fin 148 push in the restriction piece 156*a* inward. Due to this, the lower-side stopper 156 does not prohibit the rotation of the outer sleeve 102.

Next, an operation of the power tool 2 tying the wire W around the rebars R will be described with reference to FIGS. 4, 9, and 16 to 18. The operation of the power tool 2 tying the wire W around the rebars R comprises a feeding-out step, a tip-end-holding step, a feeding-backward step, a rear-end-holding step, a cutting step, a pulling step, and a twisting step. The feeding-out step, the tip-end-holding step, the feeding-backward step, the rear-end-holding step, the cutting step, the pulling step, and the twisting step are performed in this order. Here, in an initial state before the power tool 2 performing the operation of tying the wire W around the rebars R, only the front portion of the screw shaft 84 is disposed inside the inner sleeve 100 as shown in FIG. 9. Further, the long in 148 is held between the restriction piece 154*a* of the upper-side stopper 154 and the restriction piece 156*a* of the lower-side stopper 156. Further, the outer sleeve 102 is positioned at the progressed position relative to the clamp guide 86. The two guide pins 110 are positioned at the front portions of the two upper-side guide holes 118*a* and the two lower-side guide holes 126*a*, and the clamping member 90 is in the fully-open state. As shown in FIG. 5, the push plate 140 is separated away from the protrusion 72*a* of the operated member 72, and the operated member 72 is positioned at the initial position.

(Feeding-Out Step)

From the initial state, when the feed motor 34 operates in the forward mode, the feeder 38 feeds out the wire W wound around the reel 16 by a predetermined length. The tip end of the wire W passes through inside the cutting member 66, the first wire passage 124, the upper-side guide passage 58*a*, the lower-side guide passage 60*a*, and the second wire passage 132 in this order. Due to this, as shown in FIG. 4, the wire W is wound in the loop shape around the rebars R.

(Tip-End-Holding Step)

From this state, when the twisting motor 76 operates in the forward mode, the screw shaft 84 rotates in the left-hand screw direction. The long fin 148 abuts the restriction piece 154*a* of the upper-side stopper 154 in the rotation direction of the outer sleeve 102, by which the rotation of the outer sleeve 102 in the left-hand screw direction is prohibited. Due to this, the outer sleeve 102 retracts relative to the clamp guide 86 together with the inner sleeve 100. As the outer sleeve 102 retracts, the two guide pins 110 move within the two upper-side guide holes 118*a* and the two lower-side guide holes 126*a* from the front portions to the intermediate positions. The clamping member 90 shifts from the fully-open state to the half-open state, by which the tip end-neighboring portion of the wire W (that is, the first clamped portion WP1) is fixed by being clamped at the first clamping portion P1 between the second upper-side protrusion 122 and the first lower-side protrusion 128. Due to this, the tip end-neighboring portion of the wire W is held by the clamping member 90. Hereinbelow, the explanation will be given by giving the tip end-neighboring portion of the wire W a reference sign WP1. The tip end-neighboring portion WP1 of the wire W is a portion from the tip end of the wire W to a position that is apart from the tip end of the wire W by a predetermined length. The predetermined length is for example 30 mm or less. In this state, the first retainer unit 123 closes the first clamping portion P1 of the clamping member 90 from the front side.

(Pulling Back Step)

From this state, when the twisting motor 76 stops and the feed motor 34 operates in the reverse mode, the feeder 38 feeds backward the wire W around the rebars R. The tip end-neighboring portion of the wire W is held by the clamping member 90, and as such, a loop diameter of the wire W around the rebars R is reduced. With the feeder 38 disposed below the guide 26 in the up-down direction, the wire W reduces its loop diameter with less possibility of distorting the loop shape of the wire W as compared to cases in which the feeder 38 is disposed at a same position as the guide 26 or in which the feeder 38 is disposed above the guide 26 in the up-down direction. The feed motor 34 stops when the control board 20 determines that torque applied to the feed motor 34 (such as a current value of the feed motor 34) exceeds a predetermined value.

(Rear-End-Holding Step)

From this state, when the twisting motor 76 operates again in the forward mode, the outer sleeve 102 further retracts together with the inner sleeve 100 relative to the clamp guide 86. As the outer sleeve 102 retracts, the two guide pins 110 move within the two upper-side guide holes 118*a* and the two lower-side guide holes 126*a* from the intermediate position to the rear portions. The clamping member 90 shifts from the half-open state to the fully-closed state, by which a rear end-neighboring portion of the wire W (that is, the second clamped portion WP2) is fixed by being clamped at the second clamping portion P2 between the first upper-side protrusion 120 and the second lower-side protrusion 130. Due to this, the rear end-neighboring portion of the wire W is held by the clamping member 90. Hereinbelow, the explanation will be given by giving the rear end-neighboring portion of the wire W a reference sign WP2. The rear end-neighboring portion WP2 of the wire W is a portion from an end of the wire W that had been cut in the cutting step (hereinbelow termed a rear end) to a position that is apart from the rear end of the wire W by a predetermined length. The predetermined length is for example 50 mm or less. In this state, the first retainer unit 123 closes the first clamping portion P1 of the clamping member 90 from the front side, and the second retainer unit 131 is disposed immediately below the second clamping portion P2 of the clamping member 90. Further, the first retainer unit 123 and the second retainer unit 131 are disposed between the rebars R and the wire W.

(Cutting Step)

From this state, the outer sleeve 102 further retracts relative to the clamp guide 86 by the forward operation of the twisting motor 76. As shown in FIG. 6, the push plate 140 is retracted together with the outer sleeve 102, abuts the protrusion 72*a* of the operated member 72 and pushes in the same rearward. When the operated member 72 pivots about the pivot axis AX2 to the cutting position, the cutting member 66 pivots about the pivot axis AX1 to the predetermined position. Due to this, the wire W passing through inside the cutting member 66 is cut. The wire W around the rebars R is held at two spots by the clamping member 90 at the vicinities of the tip end and the rear end of the wire W.

(Pulling Step)

Figure 16:
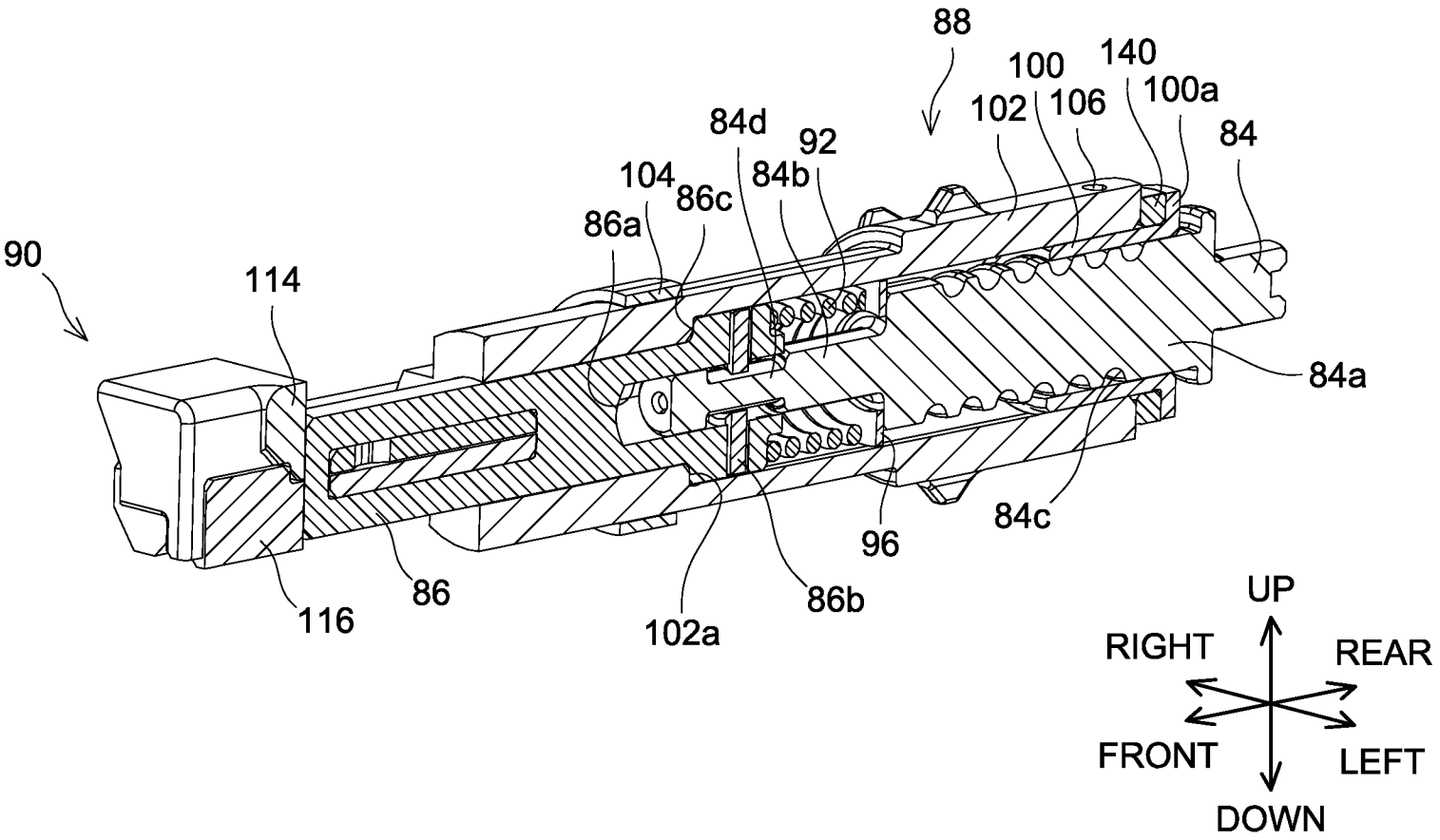
FIG. 16 is a cross-sectional perspective view of the holder 82 of the power tool 2 of the first embodiment in a state where a step portion 102*a* of the outer sleeve 102 and a step portion 86*c* of the clamp guide 86 abut each other.

From this state, when the outer sleeve 102 further retracts relative to the clamp guide 86 by the forward operation of the twisting motor 76, the step portion 102*a* of the outer sleeve 102 abuts the step portion 86*c* of the clamp guide 86 as shown in FIG. 16. Due to this, the outer sleeve 102 can no further retract relative to the clamp guide 86, thus retracts integrally with the clamp guide 86. Due to this, the clamping member 90 retracts, that is, the clamping member 90 moves in a direction separating away from the rebars R, by which the wire W around the rebars R is pulled in the direction separating away from the rebars R. While the pulling step is performed, the first retainer unit 123 closes the front side of the first clamping portion P1 and the second retainer unit 131 is disposed on the front side immediately below the second clamping portion P2. Due to this, in a case where the wire W moves forward relative to the clamping member 90 due to a tensile force applied to the wire W due to the wire W being pulled, the tip end-neighboring portion WP1 of the wire W abuts the first retainer unit 123 and the rear end-neighboring portion WP2 of the wire W abuts the second retainer unit 131. Due to this, the wire W does not slip out of the clamping member 90, and is pulled in the direction separating away from the rebars R.

(Twisting Step)

Figure 17:
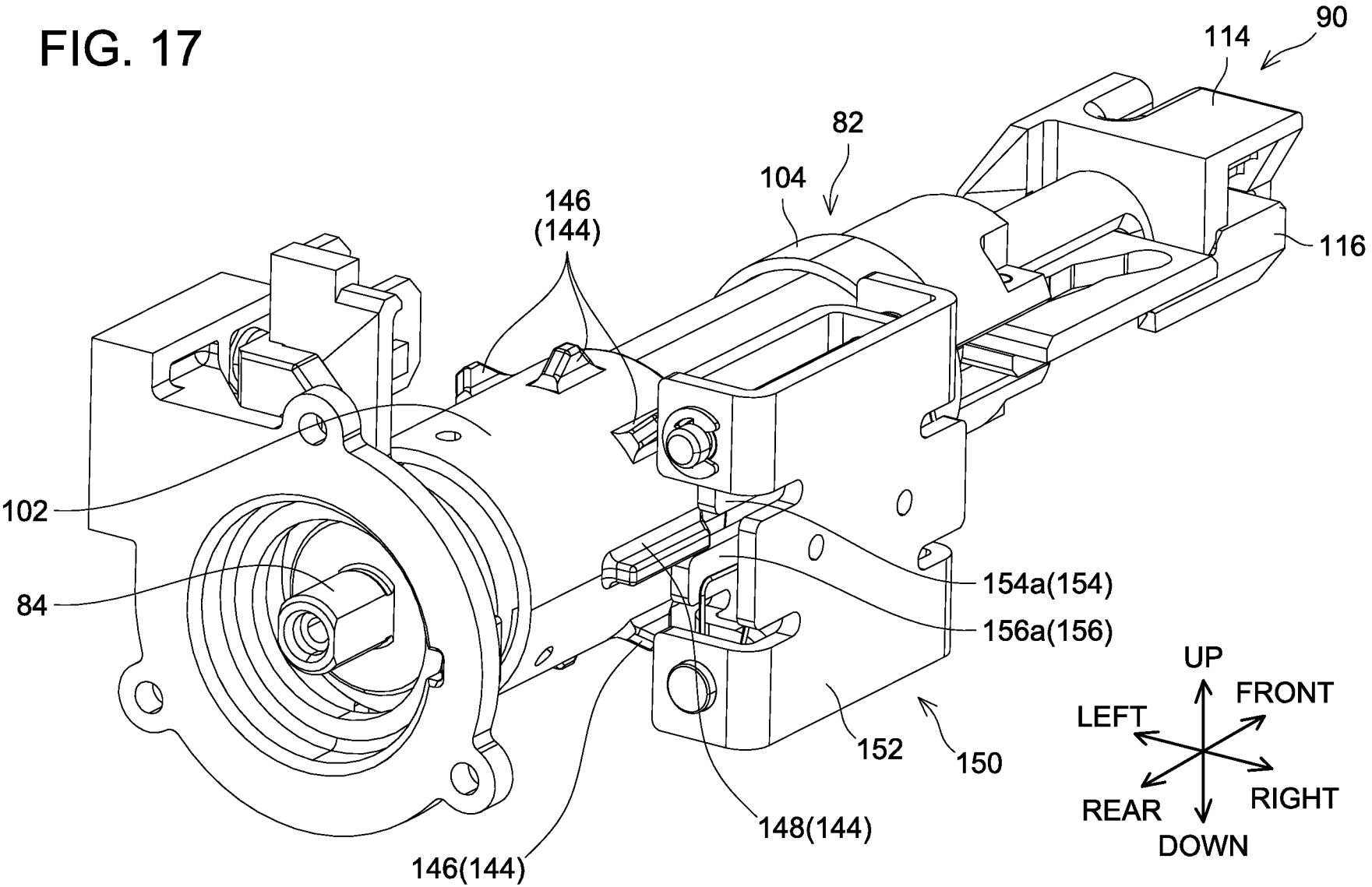
FIG. 17 is a perspective view of the holder 82 and the rotation restricting member 150 of the power tool 2 of the first embodiment in a state of having detached a base member 152 and biasing members 162, 164.

From this state, when the outer sleeve 102 retracts together with the clamp guide 86 by the forward operation of the twisting motor 76, the long fin 148 releases its abutment with the restriction piece 154*a* of the upper-side stopper 154 in the rotation direction of the outer sleeve 102 as shown in FIG. 17. Due to this, the rotation of the outer sleeve 102 in the left-hand screw direction is allowed. In this state, the biasing member 92 is compressed, and the biasing force working in the direction separating the clamp guide 86 from the washer 96 is applied from the biasing member 92 to the clamp guide 86. Due to this, a frictional force acts between the ball 94 fitted in the ball hole of the inner sleeve 100 and the ball groove 84*c* of the screw shaft 84. As a result, when the clamp guide 86 rotates, the outer sleeve 102 does not retract relative to the screw shaft 84 but rather, the outer sleeve 102 rotates integrally with the screw shaft 84 in the left-hand screw direction. Due to this, the clamp guide 86 and the clamping member 90 rotate in the left-hand screw direction, and the wire W held by the clamping member 90 is thereby twisted. Similar to when the pulling step is performed, the first retainer unit 123 closes the front side of the first clamping portion P1 and the second retainer unit 131 is disposed on the front side immediately below the second clamping portion P2 while the twisting step is being performed. Due to this, in a case where the wire W moves forward relative to the clamping member 90 due to the tensile force applied to the wire W due to the wire W being twisted, the tip end-neighboring portion WP1 of the wire W abuts the first retainer unit 123 and the rear end-neighboring portion WP2 of the wire W abuts the second retainer unit 131. Due to this, the wire W is twisted without slipping out of the clamping member 90. The forward operation of the twisting motor 76 stops when the control board 20 determines that torque applied to the twisting motor 76 (such as a current value of the twisting motor 76) exceeds a predetermined value.

After this, the twisting motor 76 operates in the reverse mode and the screw shaft 84 rotates in the right-hand screw direction. The outer sleeve 102 rotates in the right-hand screw direction, the short fins 146 or the long fin 148 abuts the restriction piece 156*a* of the lower-side stopper 156, and the rotation of the outer sleeve 102 in the right-hand screw direction is prohibited. The biasing force that biases the clamp guide 86 in the direction separating away from the washer 96 is applied from the biasing member 92 to the clamp guide 86, by which the outer sleeve 102 progresses integrally with the clamp guide 86. When the engaging pin 86*b* abuts a front end of the engaging groove 84*d*, the outer sleeve 102 progresses relative to the clamp guide 86. When the two guide pins 110 move within the two upper-side guide holes 118*a* and the two lower-side guide holes 126*a* from the rear portions to the front portions, the clamping member 90 shifts to the fully-open state. Due to this, the wire W that was held by the clamping member 90 is released from the clamping member 90. In the case where the short fins 146 were in abutment with the restriction piece 156*a*, when the outer sleeve 102 progresses forward relative to the clamp guide 86 and the short fins 146 move in front of a front end of the restriction pieces 156*a*, the outer sleeve 102 rotates in the right-hand screw direction again. When the long fin 148 abuts the restriction piece 156*a*, the rotation of the outer sleeve 102 is prohibited. Due to this, the clamping member 90 returns to its initial angle.

(Effect)

A power tool 2 of the present embodiment is a rebar tying tool. The power tool 2 comprises a twisting mechanism 30. As shown in FIG. 7, the twisting mechanism 30 comprises a holder 82 configured to hold a wire W wound (wrapped) around rebars R and a twisting motor 76 configured to operate the holder 82. The twisting mechanism 30 is configured to perform a pulling operation of operating the twisting motor 76 to pull the wire W held by the holder 82 in a direction separating away from the rebars R and a twisting operation of operating the twisting motor 76 to twist the wire W held by the holder 82.

In the above configuration, the twisting mechanism 30 is configured to perform the pulling operation and the twisting operation with the twisting motor 76, that is, with one motor. Due to this, as compared to a case in which the twisting mechanism 30 performs the pulling operation and the twisting operation using multiple motors, control for operating the motor can be simplified.

The twisting mechanism 30 further comprises a fixing unit configured to fix a tip end of the wire wound around the rebars or a portion of the wire wound around the rebars in a vicinity of a tip end (a tip end-neighboring portion). The fixing unit is the clamping member 90. The power tool 2 further comprises a feed mechanism 24. As shown in FIG. 3, the feed mechanism 24 comprises a feeder 38 configured to feed out the wire W and a feed motor 34 configured to operate the feeder 38. The feed mechanism 24 is configured to perform a feeding-out operation of operating the feed motor 34 to feed out the wire W around the rebars R, and a feeding backward operation of operating the feed motor 34 to feed backward the wire W from around the rebars R.

In the above configuration, even in a case where the wire W fed out around the rebars R by the feeding-out operation is loosened, the feed mechanism 24 can perform the feeding-backward operation to reduce a loop diameter of the wire W around the rebars R and bring the wire W into close contact with the rebars R.

The holder 82 comprises a screw shaft 84 configured to rotate by operation of the twisting motor 76 and a clamping member 90 configured to open and close in conjunction with rotation of the screw shaft 84.

In the above configuration, the wire W is held by the clamping member 90, which has been open, being closed. Due to this, the wire W can be held with a simple configuration that uses opening and closing of the clamping member 90.

As shown in FIG. 9, the holder 82 further comprises a clamp guide 86 configured to support the clamping member 90 and a sleeve 88 through which the clamp guide 86 and the screw shaft 84 are inserted. The sleeve 88 is configured to progress and retract relative to the clamp guide 86 in accordance with the rotation of the screw shaft 84, where the clamping member 90 is open when the sleeve 88 is in a progressed position in which the sleeve 88 is progressed relative to the clamp guide 86, and the clamping member 90 is closed when the sleeve 88 is in a refracted position in which the sleeve 88 is retracted relative to the clamp guide 86.

In the above configuration, the clamp guide 86 and the screw shaft 84 are inserted into the sleeve 88. Due to this, opening and closing operations of the clamping member 90 can be realized with such a simple configuration using the rotation of the screw shaft 84

The sleeve 88 is coupled to the screw shaft 84 via a ball screw. As shown in FIG. 7, the sleeve 88 comprises a fin 144 protruding from an outer surface of the sleeve 88. The power tool 2 further comprises a stopper 154, 156 (as shown in FIG. 15) configured to abut the fin 144 in a rotation direction of the sleeve 88. The sleeve 88 progresses and retracts in accordance with the rotation of the screw shaft 84 when the fin 144 and the stopper 154, 156 abut each other, while the sleeve 88 rotates in accordance with the rotation of the screw shaft 84 when the fin 144 and the stopper 154, 156 do not abut each other.

In the above configuration, progressing and retracting operations and a rotating operation of the sleeve 88 can be changed by a simple configuration that uses abutment of the fin 144 and the stopper 154, 156.

The power tool 2 further comprises a cutting mechanism 28. As shown in FIG. 5, the cutting mechanism 28 comprises a cutting member 66 configured to cut the wire W. The holder 82 comprises a push plate 140 that operates the cutting member 66 in conjunction with the operation of the twisting motor 76.

In the above configuration, the push plate 140 is configured to operate the cutting member 66 in conjunction with the operation of the twisting motor 76. Due to this, a separate motor for operating the cutting member 66 does not need to be provided.

A tying method is a method of tying the wire W around the rebars R by the operation of the twisting motor 76. The tying method comprises: feeding out the wire W around the rebars R; holding the wire W wound around the rebars R; pulling the held wire W by an operation of the twisting motor 76 in a direction separating away from the rebars R; and twisting the held wire W held by the operation of the twisting motor 76.

In the above configuration, the puling and the twisting are performed by the twisting motor 76, that is, with one motor. Due to this, as compared to a case in which the pulling and the twisting are performed using multiple motors, the control for operating the motor can be simplified.

The tying method further comprises: fixing a tip end of the wire wound around the rebars or a portion of the wire wound around the rebars in a vicinity of the tip end (tip end-neighboring portion); and feeding backward the wire W from around the rebars R.

In the above configuration, even in the case where the wire W fed out around the rebars R by the feeding out is loosened, the loop diameter of the wire W around the rebars R can be reduced by performing the feeding backward, by which the wire W can be brought into close contact with the rebars R.

A power tool 2 comprises a twisting mechanism 30, a body 4, a grip 6, and a control board 20. The twisting mechanism 30 comprises a twisting motor 76 and a holder 82 configured to twist a wire W around rebars R by operation of the twisting motor 76. As shown in FIG. 2, the body 4 houses the twisting mechanism 30. The grip 6 is disposed below the body 4 and configured to be gripped by an operator. The control board 20 is configured to control the operation of the twisting motor 76. The control board 20 is disposed below a connection between the grip 6 and the body 4.

In the above configuration, since the control board 20 is disposed below the connection between the grip 6 and the body 4, heat generated by the operation of the twisting motor 76 is less likely to be transmitted to the control board 20 as compared to a case in which the control board 20 is housed in the body 4. Due to this, a temperature of the control board 20 is suppressed from becoming high, and an occurrence of an operational defect in controlling the twisting motor 76 by the control board 20 can be suppressed.

As shown in FIG. 2, the power tool 2 further comprises a battery pack B disposed below the grip 6 and configured to supply electric power to the twisting motor 76. The control board 20 is disposed between the grip 6 and the battery pack B.

In the above configuration, the battery pack B and the control board 20 are electrically connected by wiring and the control board 20 and the twisting motor 76 are electrically connected by wiring. In the above configuration, since the battery pack B, the control board 20, and the twisting motor 76 are arranged in this order, lengths of the wiring can be shortened as compared to a case in which the battery pack B, the control board 20, and the twisting motor 76 are not arranged in this order.

As shown in FIG. 2, the power tool 2 further comprises a battery receptacle 10 disposed below the grip 6 and configured to receive the battery pack B. The control board 20 is housed in the battery receptacle 10.

In the above configuration, a separate member for housing the control board 20 does not need to be provided.

A power tool 2 is a rebar tying tool. The power tool 2 ties the wire W around the rebus R. The power tool 2 comprises a clamping member 90 comprising an upper-side clamping member 114 and a lower-side clamping member 116 facing the upper-side clamping member 114 in an up-down direction. As shown in FIG. 14, the clamping member 90 is configured to clamp a first clamped portion WP1 and a second clamped portion WP2 that are located in respective ends-neighboring portions of the wire W around the rebars R between the upper-side clamping member 114 and the lower-side clamping member 116.

In the above configuration, the wire W around the rebars R is clamped by the two members, being the upper-side clamping member 114 and the lower-side clamping member 116. Due to this, as compared to a ease of clamping the wire W around the rebars R by three members, a portion of the clamping member 90 for clamping the wire W can be made compact.

As shown in FIG. 10, the upper-side clamping member 114 comprises a first upper-side protrusion 120 and a second upper-side protrusion 122. As shown in FIG. 11, the lower-side clamping member 116 comprises a first lower-side protrusion 128 and a second lower-side protrusion 130. As shown in FIG. 14, the clamping member 90 clamps the first clamped portion WP1 of the wire W at a first clamping portion P1 between the second upper-side protrusion 122 and the first lower-side protrusion 128, and clamps the second clamped portion WP2 of the wire W at a second clamping portion P2 between the first upper-side protrusion 120 and the second lower-side protrusion 130.

In the above configuration, the first clamped portion WP1 of the wire W is clamped at the first clamping portion P1 of the clamping member 90, and the second clamped portion WP2 of the wire W is clamped at the second clamping portion P2 of the clamping member 90. In other words, the wire W is clamped at two portions of the clamping member 90. As a result, the wire W can be suppressed from slipping out of the clamping member 90 as compared to a case of clamping both the first and second clamped portions WP1, WP2 of the wire W being clamped at only one portion of the clamping member 90.

The clamping member 90 clamps the second clamped portion WP2 of the wire W at the second clamping portion P2 after having clamped the first clamped portion WP1 of the wire W at the first clamping portion P1.

In the above configuration, a period for performing another operation may be ensured after the first clamped portion WP1, of the wire W is clamped by the clamping member 90 and before the second clamped portion WP2 of the wire W is clamped.

The power tool 2 further comprises a feeder 38 configured to feed backward the wire around the rebars. The feeder 38 performs a feeding-backward operation. The first clamped portion WP1 of the wire W is a tip end-neighboring portion WP1 of the wire W. The feeder 38 feeds backward the wire W from the rebars R in a state where the clamping member 90 is clamping the first clamped portion WP1 of the wire W at the first clamping portion P1, but not clamping the second clamped portion WP2 of the wire W at the second clamping portion P2.

In the above configuration, the wire W is rewound from the rebars R by an operation of the feeder 38 in a state where the tip end-neighboring portion WP1 of the wire W is clamped by the clamping member 90. Due to this, the wire W can be brought into close contact around the rebars R.

The clamping member 90 further comprises retainer units 123, 131 (see FIG. 14) configured to be disposed between the rebars R and the wire W when the wire W is clamped by the clamping member 90. The retainer units 123, 131 is configured to suppress the first and second clamped portions WP1, WP2 of the wire W from slipping out from between the upper-side and lower-side clamping members 114, 116.

In the above configuration, the first and second clamped portions WP1, WP2 of the wire W are suppressed by the retainer units 123, 131 from slipping out of the clamping member 90. Due to this, a defect of tying the wire W caused by at least one of the first and second clamped portions WP1, WP2 of the wire W slipping out of the clamping member 90 can be suppressed.

When the upper-side clamping member 114 moves, the lower-side clamping member 116 moves in conjunction therewith.

In the above configuration, a period required for the clamping member 90 to clamp the wire W can be shortened as compared to a case in which only one of the upper-side clamping member 114 and the lower-side clamping member 116 moves.

When the upper-side clamping member 114 and the lower-side clamping member 116 are seen along the up-down direction, the upper-side clamping member 114 and the lower-side clamping member 116 moves in directions approaching closer to each other.

In the above configuration, a distance by which the upper-side and lower-side clamping members 114, 116 move can be shortened as compared to a case in which only one of the upper-side and lower-side clamping members 114, 116 moves toward the other of the upper-side and lower-side clamping members 114, 116.

(Corresponding Relationship)

The clamping member 90 is an example of a "fixing unit", the tip-end-holding step is an example of "fixing a tip end of the wire", the feeder 38 is an example of a "feeding backward unit". The upper-side clamping member 114 is an example of a "first clamping member", the first upper-side protrusion 120 is an example of a "first portion", and the second upper-side protrusion 122 is an example of a "second portion". The lower-side clamping member 116 is an example of a "second clamping member", the first lower-side protrusion 128 is an example of a "third portion", and the second lower-side protrusion 130 is an example of a "fourth portion". The up-down direction is an example of a "first direction".

Second Embodiment

Figure 18:
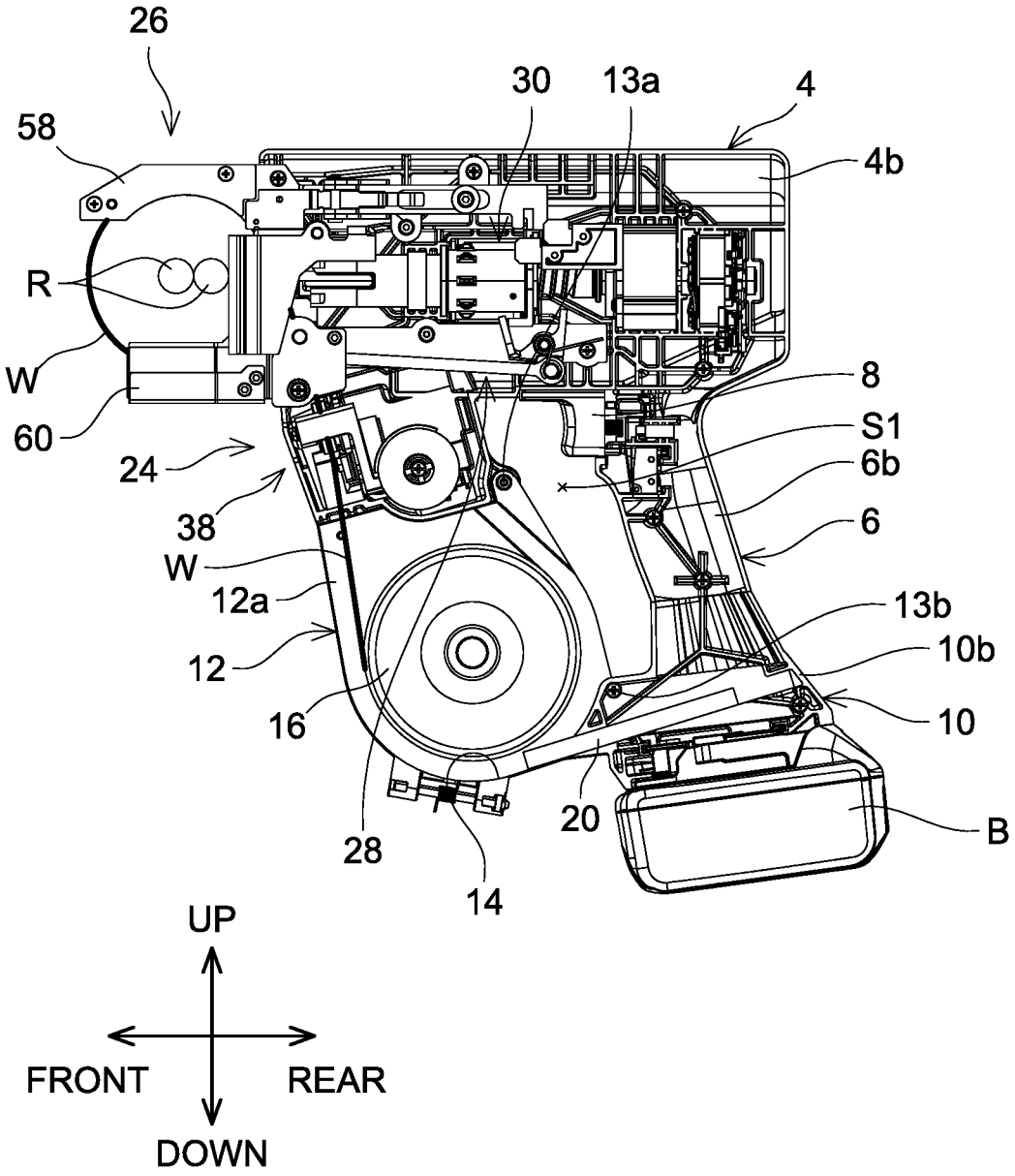
FIG. 18 is a side view of a power tool 2 of a second embodiment in a state of having detached a left-side body 4*a*, a left-side grip 6*a*, a left-side battery receptacle 10*a*, and a cover member 12*b*.

A second embodiment will be described with reference to FIG. 18. In the second embodiment, points that differ from the first embodiment will be described, and points that are similar to the first embodiment will be given similar reference signs and description thereof will be omitted. In the second embodiment, an arrangement of the control board 20 is different from an arrangement of the control board 20 of the first embodiment. The housing space 14 of the reel holder 12 communicates with an internal space of the battery receptacle 10. A front portion of the control board 20 is disposed in the housing space 14, and a rear portion of the control board 20 is disposed in the internal space of the battery receptacle 10. The control board 20 is disposed traversing the housing space 14 and the internal space of the battery receptacle 10. The control board 20 is disposed traversing below the grip 6 and below the reel 16. The grip 6 and the reel 16 are disposed in a space between the control board 20 and the body 4. Although not shown, wiring extending from the control board 20 to the feed motor 34 extends through the housing space 14, and wiring extending from the control board 20 to the twisting motor 76 extends through inside the grip 6. Due to this, the wiring extending from the control board 20 to the feed motor 34 does not need to be extended through inside of the body 4.

(Effect)

A power tool 2 of the present embodiment further comprises a reel 16 around which the wire W is to be wound. The reel 16 is disposed in front of the grip 6 and below the body 4. The control board 20 is disposed traversing below the grip 6 and below the reel 16.

In the above configuration, a space between the body 4 and the control board 20 can be efficiently used as compared to a configuration in which the control board 20 is not disposed traversing below the grip 6 and below the reel 16.

Third Embodiment

Figure 19:
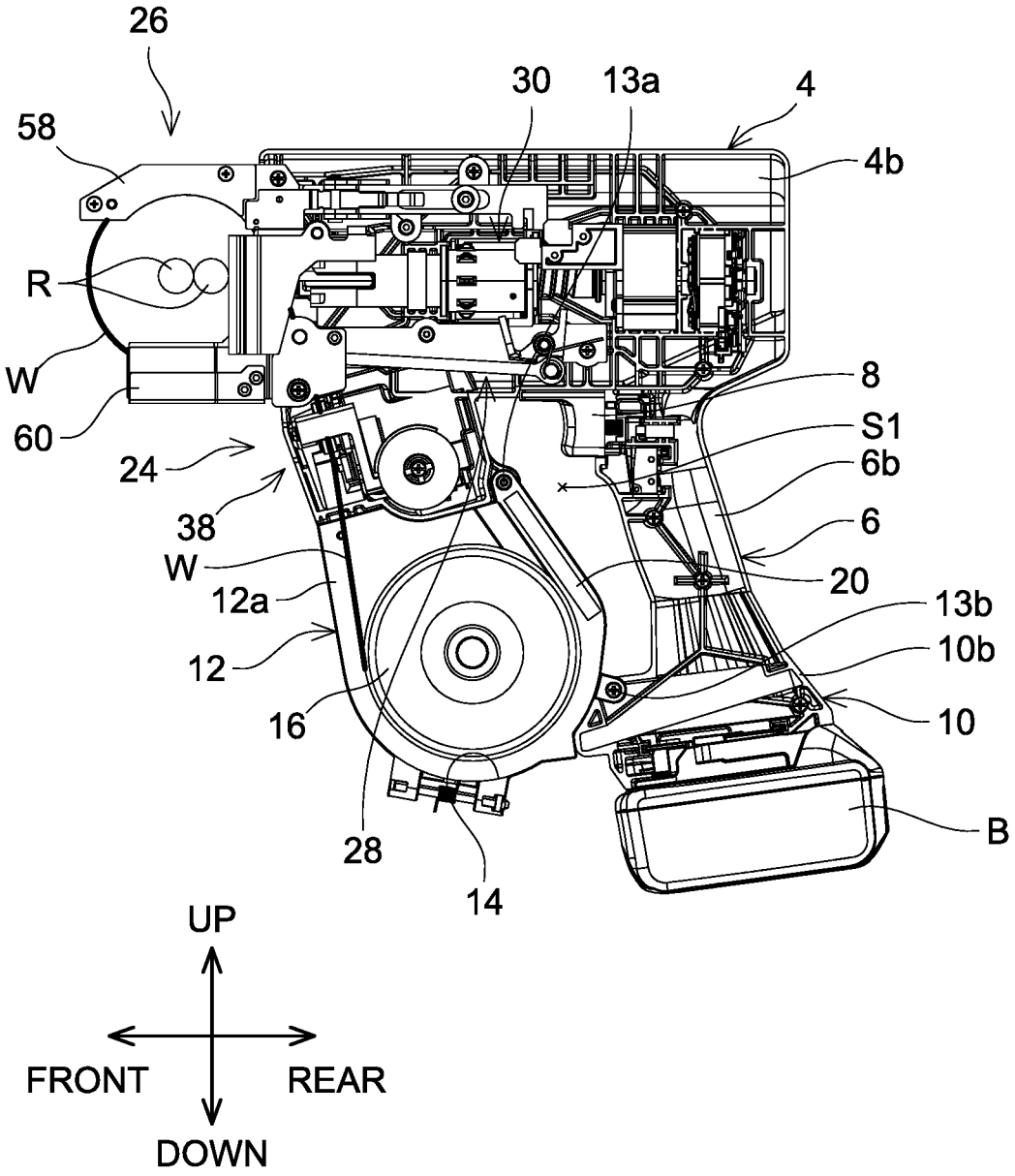
FIG. 19 is a side view of a power tool 2 of a third embodiment in a state of having detached a left-side body 4*a*, a left-side grip 6*a*, a left-side battery receptacle 10*a*, and a cover member 12*b*.

A third embodiment will be described with reference to FIG. 19. In the third embodiment, points that differ from the first embodiment will be described, and points that are similar to the first embodiment will be given similar reference signs and description thereof will be omitted. In the third embodiment, an arrangement of the control board 20 differs from the arrangement of the control board 20 of the first embodiment. The control board 20 is disposed on a rear upper side of the reel 16 and in front of the grip 6. The control board 20 is disposed between the reel 16 and the grip 6. The control board 20 is disposed in the housing space 14 of the reel holder 12.

(Effect)

A power tool 2 of the present embodiment further comprises a reel 16 around which the Wire W is to be wound. The reel 16 is disposed in front of the grip 6 and below the body 4. The control board 20 is disposed between the grip 6 and the reel 16.

In the above configuration, a space between the grip 6 and the reel 16 can be efficiently used as compared to a configuration in which the control board 20 is not disposed between the grip 6 and the reel 16.

Fourth Embodiment

Figure 20:
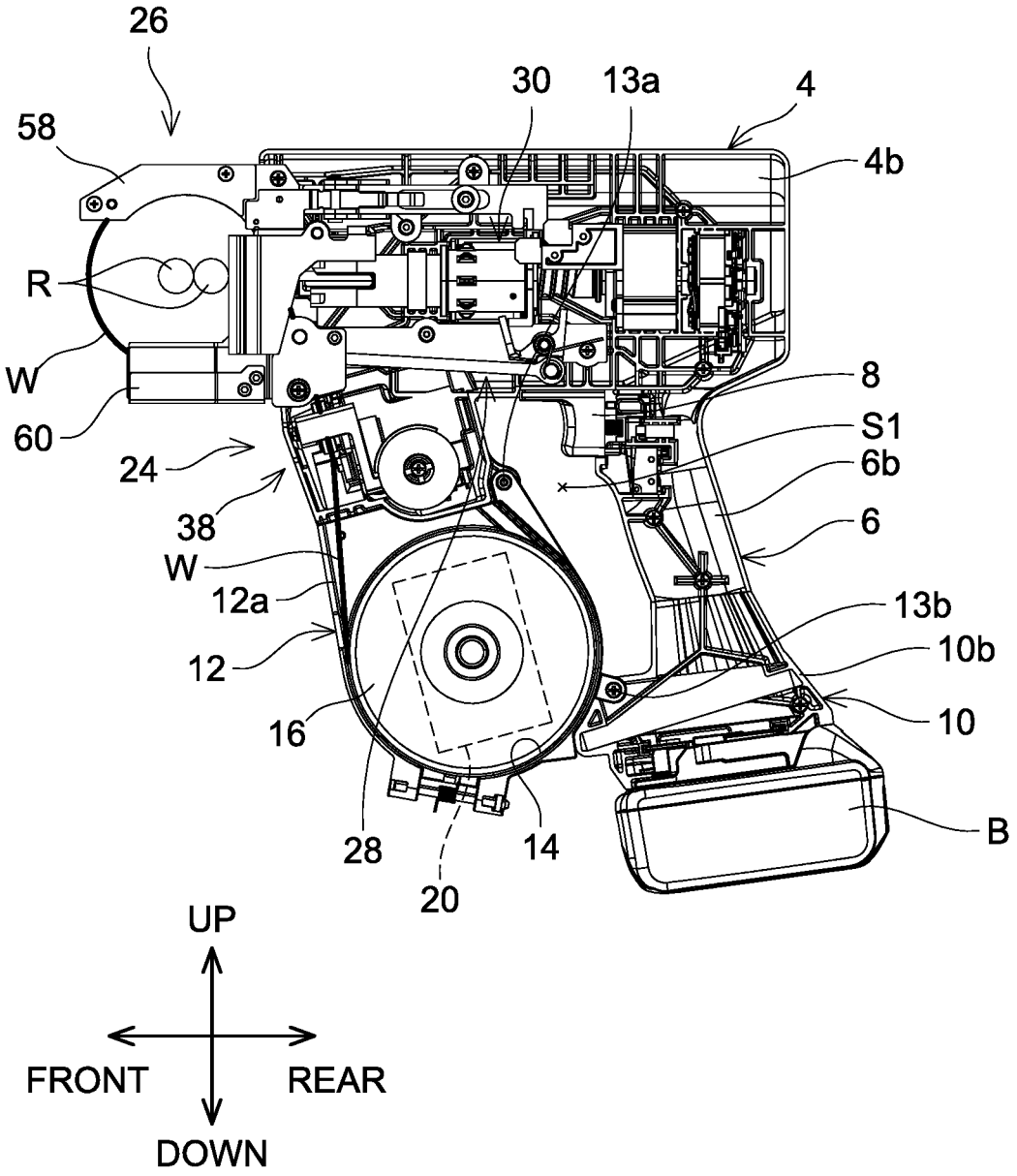
FIG. 20 is a side view of a power tool 2 of a fourth embodiment in a state of having detached a left-side body 4*a*, a left-side grip 6*a*, a left-side battery receptacle 10*a*, and a cover member 12*b*.

A fourth embodiment will be described with reference to FIG. 20. In the fourth embodiment, points that differ from the first embodiment will be described, and points that are similar to the first embodiment will be given similar reference signs and description thereof will be omitted. In the fourth embodiment, an arrangement of the control board 20 differs from the arrangement of the control board 20 of the first embodiment. The control board 20 is disposed to overlap the reel 16 in the left-right direction. The control board 20 is disposed on the right side of the reel 16. In FIG. 20, the control board 20 cannot be seen by being hidden behind the reel 16, however, to facilitate understanding of the position of the control board 20, the control board 20 is indicated by a broken line. The control board 20 is disposed in the housing space 14.

(Effect)

A power tool 2 of the present embodiment further comprises a reel 16 around which the wire W is to be wound. The reel 16 is disposed in front of the grip 6 and below the body 4. The control board 20 is disposed to overlap the reel 16 in a left-right direction.

In the above configuration, the power tool 2 can be suppressed from increasing its size in a front-rear direction as compared to a case in which the control board 20 is not disposed to overlap the reel 16 in the left-right direction.

Fifth Embodiment

Figure 21:
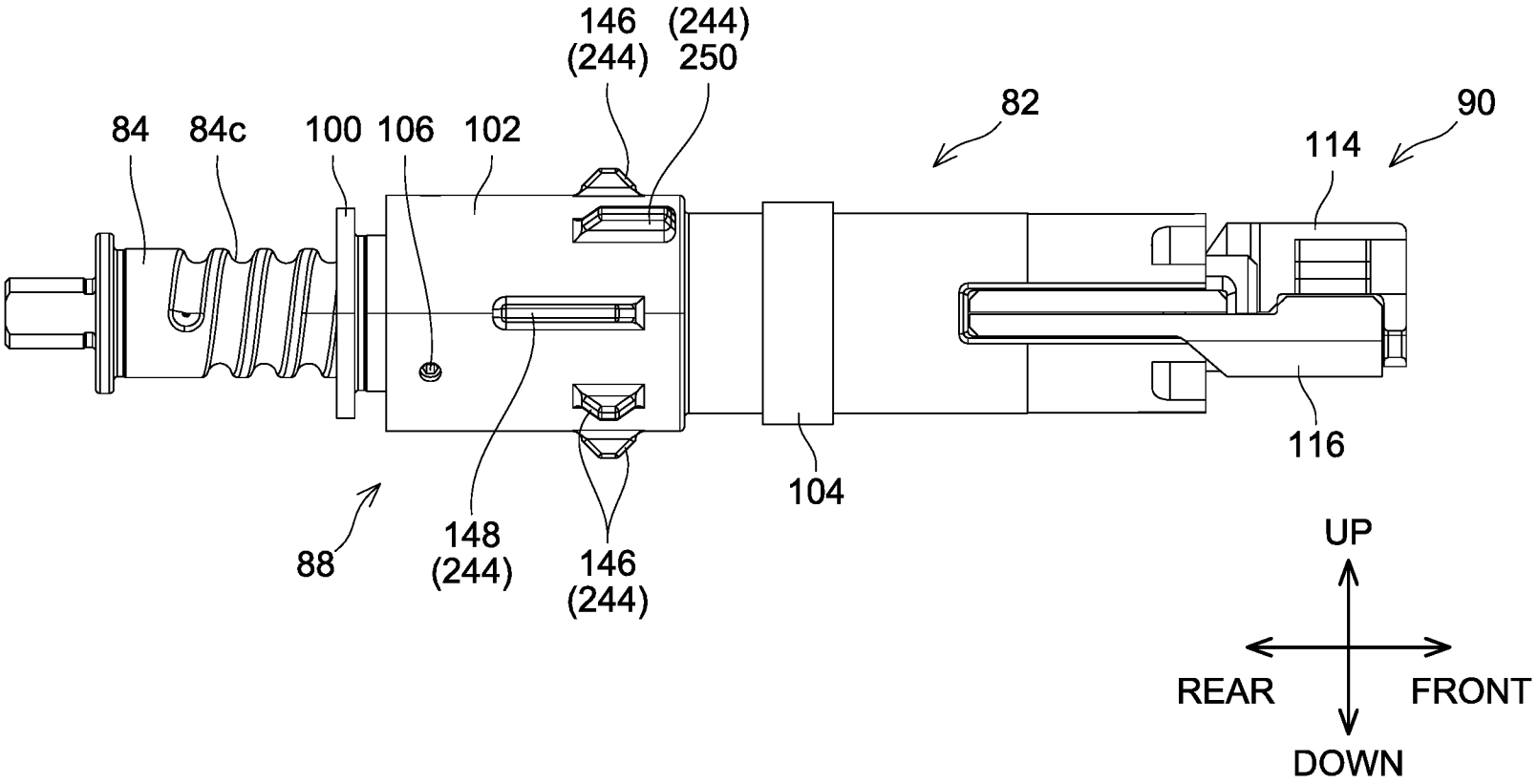
FIG. 21 is a right-side view of a screw shaft 84, a clamping member 90, and an outer sleeve 102 of a power tool 2 of a fifth embodiment.

A fifth embodiment will be described with reference to FIG. 21. In the fifth embodiment, points that differ from the first embodiment will be described, and points that are similar to the first embodiment will be given similar reference signs and description thereof will be omitted. In the fifth embodiment, one short fin 146 among the seven short fins 146 of the first embodiment is replaced with a long fin 250. Fins 244 comprise six short fins 146, one long fin 148, and one long fin 250. Hereinbelow, to facilitate understanding of a difference between the long fins 148, 250, the long fin 148 will be termed a first long fin 148 and the long fin 250 will be termed a second long fin 250. Eight fins are radially disposed. Eight fins are disposed on the outer circumferential surface of the outer sleeve 102 with the 45-degrees interval between each other, and the first long fin 148 and the second long fin 250 are adjacent to each other. When the outer sleeve 102 is seen from the rear side, the second long fin 250 is disposed toward the left-hand screw direction from the first long fin 148.

A length of the second long fin 250 in the front-rear direction is longer than a length of the short fins 146 in the front-rear direction. In the front-rear direction, a position of a rear end of the second long fin 250 is same as the positions of the rear ends of the short fins 146. On the other hand, in the front-rear direction, a front end of the second long fin 250 is disposed on front side of both the front ends of the short fins 146 and the front end of the first long fin 148.

Next, the operation of the power tool 2 tying the wire W around the rebars R will be described. In the fifth embodiment, the twisting step, the pulling step, and the twisting step are performed in this order after the pulling step of the first embodiment has been performed. Hereinbelow, the twisting step performed first is termed a first twisting step, and the twisting step performed second is termed a second twisting step.

(First Twisting Step)

After the pulling step has been performed, the wire W around the rebars R is held at two spots by the clamping member 90 at the tip end-neighboring portion WP1 and the rear end-neighboring portion WP2 of the wire W. Further, after the pulling step has been performed, the first long fin 148 is not in abutment with the restriction piece 154*a* of the upper-side stopper 154 in the rotation direction of the outer sleeve 102, thus the rotation of the outer sleeve 102 in the left-hand screw direction is allowed. From this state, when the twisting motor 76 operates in the forward mode, the outer sleeve 102 rotates integrally with the screw shaft 84 in the left-hand screw direction. Due to this, the clamp guide 86 and the clamping member 90 rotate in the left-hand screw direction, by which the wire W held by the clamping member 90 is twisted. When the outer sleeve 102 rotates 315 degrees in the left-hand screw direction, the second long fin 250 abuts the restriction piece 154*a* in the rotation direction of the outer sleeve 102. Due to this, the rotation of the outer sleeve 102 in the left-hand screw direction is prohibited.

(Pulling Step)

From this state, when the twisting motor 76 operates in the forward mode, the outer sleeve 102 retracts integrally with the clamp guide 86. Due to this, the clamping member 90 retracts, that is, the clamping member 90 moves in the direction separating away from the rebars R, by which the wire W that had once been twisted in the first twisting step is pulled in the direction separating away from the rebars R.

(Second Twisting Step)

From this state, when the outer sleeve 102 retracts by the forward operation of the twisting motor 76, the second long fin 250 that has been moving between the restriction pieces 154*a*, 156*a* releases its abutment with the restriction piece 154*a* in the rotation direction of the outer sleeve 102. Due to this, the rotation of the outer sleeve 102 in the left-hand screw direction is allowed again. As a result, the outer sleeve 102 again rotates integrally with the screw shaft 84 in the left-hand screw direction. Due to this, the clamp guide 86 and the clamping member 90 again rotate in the left-hand screw direction, and the wire W held by the clamping member 90 is twisted again. The forward operation of the twisting motor 76 stops when the control board 20 determines that the torque applied to the twisting motor 76 (such as the current value of the twisting motor 76) exceeds a predetermined value.

After this, the twisting motor 76 operates in the reverse mode, by which the clamping member 90 returns to its initial angle with a same principle as that of the first embodiment.

(Effect)

In the tying method of the present embodiment, the pulling is performed after the twisting has been performed, and the twisting is performed again thereafter.

In a case where the wire W is twisted in a state of being caught at a separated spot, which is separated from a desired tying spot of the rebars R, when the wire W may dislocate from the separated spot to the tying spot while the wire W is being twisted, a gap is defined between the rebars R and the wire W and tying becomes defective. In the above configuration, after having been twisted in the twisting, the wire W is pulled in the direction separating away from the rebars R in the pulling, and is twisted again in the twisting that takes place thereafter. Due to this, even when a gap is defined between the rebars R and the wire W due to the wire W being dislocated from the separated spot while the twisting for the first time is performed, the gap between the rebars and the wire W is reduced by undergoing the pulling and the twisting for the second time, by which an occurrence of the tying becoming defective can be suppressed.

Sixth Embodiment

In a sixth embodiment, points that differ from the fifth embodiment will be described, and points that are similar to the fifth embodiment will be given similar reference signs and description thereof will be omitted. In the sixth embodiment, the lengths of the short fins 146 and the first long fin 148 are shorter than the lengths of the short fins 146 and the first long fin 148 in the fifth embodiment. The front ends of the short fins 146 and the first long fin 148 of the sixth embodiment are disposed on the rear side of the front ends of the short fins 146 and the first long fin 148 of the fifth embodiment. The positions of the rear ends of the short fins 146 and the first long fin 148 of the sixth embodiment are same as the positions of the rear ends of the short fins 146 and the first long fin 148 of the fifth embodiment. Due to this, in the sixth embodiment, the first long fin 148 is not in abutment with the restriction piece 154*a* of the upper-side stopper 154 in the rotation, direction of the outer sleeve 102 after the cutting step of the fifth embodiment has been performed, thus the rotation of the outer sleeve 102 in the left-hand screw direction is allowed. Due to this, after the cutting step has been performed, the first twisting step is performed without performing the pulling step in between them. That is, in the sixth embodiment, the first twisting step, the pulling step, and the second twisting step are performed in this order after the cutting step of the fifth embodiment has been performed.

In a power tool 2 according to an embodiment, a fixing unit configured to hold the tip end-neighboring portion WP1 of the wire W may be provided separate from the clamping member 90.

In a power tool 2 according to an embodiment, the pulling step and the twisting step may be performed simultaneously.

In this case, the wire W is twisted simultaneously as the wire W is pulled in the direction separating away from the rebars R.

In the power tool 2 according to an embodiment, the interval between the first long fin 148 and the second long fin 250 on the outer circumferential surface of the outer sleeve 102 is not limited to the interval described in the fifth embodiment. For example, the first long fin 148 and the second long fin 250 may be arranged with the interval of 180 degrees.

In the power tool 2 according to an embodiment, only one of the upper-side clamping member 114 and the lower-side clamping member 116 may move. Further, the upper-side clamping member 114 and the lower-side clamping member 116 may move independent from one another.

In the power tool 2 according to an embodiment, the clamping member 90 may clamp the tip end-neighboring portion WP1 of the wire W at the first clamping portion P1 after having clamped the rear end-neighboring portion WP2 of the wire W at the second clamping portion P2.

In the power tool 2 according to an embodiment, the feeding-backward operation may not be performed.

In the power tool 2 according to an embodiment, the upper-side clamping member 114 and the lower-side clamping member 116 may move along the up-down direction in directions approaching each other.

In the power tool 2 according to an embodiment, the clamping member 90 may clamp the tip end-neighboring portion WP1 and the rear end-neighboring portion WP2 of the wire W at a single spot. For example, when the wire W is wound around the rebars R and the tip end-neighboring portion WP1 and the rear end-neighboring portion WP2 intersect and overlap, the clamping member 90 may clamp the overlapped tip end-neighboring portion WP1 and rear end-neighboring portion WP2 of the wire W at the first clamping portion P1 or at the second clamping portion P2.

In the power tool 2 according to an embodiment, the upper-side clamping member 114 and the first retainer unit 123 may be separate members. Further, the lower-side clamping member 116 and the second retainer unit 131 may be separate members.

In the power tool 2 according to an embodiment, the clamping member 90 may not comprise the first retainer unit 123 or the second retainer unit 131, and may comprise only one retainer unit. In this case, the one retainer unit may be configured to suppress the tip end-neighboring portion WP1 and the rear end-neighboring portion WP2 of the wire W from slipping out of the clamping member 90.

In the power tool 2 according to an embodiment, the wire W may be clamped by the clamping member 90 by the upper-side clamping member 114 and the lower-side clamping member 116 moving in the up-down direction.

The control board 20 of the power tool 2 according to an embodiment may not be disposed in the housing space 14 but may be disposed to overlap the reel 16 in the left-right direction outside the reel holder 12. In this case, a housing for housing the control board 20 may be attached to the reel holder 12.

The reel holder 12 of the power tool 2 according to an embodiment may house collated screws or brad nails instead of the reel 16 around which the wire W is wound. In this case, the power tool 2 may be configured to drive screws or nails into a target object.

What is claimed is:

1. A rebar tying tool comprising:
a twisting mechanism comprising a twisting motor and a holder configured to twist a wire around rebars by operation of the twisting motor;
a body housing the twisting mechanism;
a grip below the body and configured to be gripped by an operator;
a control board configured to control the operation of the twisting motor;
a battery pack below the grip and configured to supply electric power to the twisting motor;
a battery receptacle below the grip and configured to receive the battery pack; and
a reel around which the wire is to be wound, wherein
the control board is below a connection between the grip and the body, is between the grip and the battery pack, and is housed in the battery receptacle,
the reel is in front of the grip and below the body, and
the control board is lower in an up-down direction than a rotation center of the reel.

2. A rebar tying tool comprising:
a twisting mechanism comprising a twisting motor and a holder configured to twist a wire around rebars by operation of the twisting motor;
a body housing the twisting mechanism;
a grip below the body and configured to be gripped by an operator;
a control board configured to control the operation of the twisting motor;
a battery pack below the grip and configured to supply electric power to the twisting motor; and
a reel around which the wire is to be wound, wherein
the control board is below a connection between the grip and the body and is between the grip and the battery pack,
the reel is in front of the grip and below the body, and
the control board traverses below the grip and below the reel.

3. The rebar tying tool according to claim 2, further comprising a reel holder in front of the grip and below the body, wherein
the reel holder is configured to support the reel, and
the control board is supported by the reel holder.

4. A rebar tying tool comprising:
a twisting mechanism comprising a twisting motor and a holder configured to twist a wire around rebars by operation of the twisting motor;
a body housing the twisting mechanism;
a grip below the body and configured to be gripped by an operator;
a control board configured to control the operation of the twisting motor; and
a reel around which the wire is to be wound, wherein
the reel is in front of the grip and below the body, and
the control board is below a connection between the grip and the body and is between the grip and the reel.

5. The rebar tying tool according to claim 4, further comprising a reel holder in front of the grip and below the body, wherein
the reel holder is configured to support the reel, and
the control board is supported by the reel holder.

6. A rebar tying tool comprising:
a twisting mechanism comprising a twisting motor and a holder configured to twist a wire around rebars by operation of the twisting motor;
a body housing the twisting mechanism;
a grip below the body and configured to be gripped by an operator;

a control board configured to control the operation of the twisting motor, and a reel around which the wire is to be wound, wherein the reel is in front of the grip and below the body, and the control board is below a connection between the grip and the body and overlaps the reel in a left-right direction.

7. The rebar tying tool according to claim 6, further comprising a reel holder in front of the grip and below the body, wherein the reel holder is configured to support the reel, and the control board is supported by the reel holder.

* * * * *